US007893014B2

(12) United States Patent
van Buskirk et al.

(10) Patent No.: US 7,893,014 B2
(45) Date of Patent: Feb. 22, 2011

(54) FABRIC TREATMENT FOR STAIN RELEASE

(75) Inventors: Gregory n.a. van Buskirk, Danville, CA (US); Victor M. Casella, Raleigh, NC (US)

(73) Assignee: Gregory van Buskirk, Danville, CA (US)

( * ) Notice: Subject to any disclaimer, the term of this patent is extended or adjusted under 35 U.S.C. 154(b) by 882 days.

(21) Appl. No.: 11/614,197

(22) Filed: Dec. 21, 2006

(65) Prior Publication Data

US 2008/0148491 A1 Jun. 26, 2008

(51) Int. Cl.
*C11D 1/38* (2006.01)
*C11D 3/37* (2006.01)
*D06L 1/02* (2006.01)

(52) U.S. Cl. ..... 510/327; 510/329; 510/330; 510/426; 510/475; 510/504; 510/516; 510/521; 510/351; 510/357; 8/137

(58) Field of Classification Search ..... 510/516, 510/504, 475, 521, 522, 327, 329, 330, 351, 510/357, 426; 252/174.21, 174.22; 8/137
See application file for complete search history.

(56) References Cited

U.S. PATENT DOCUMENTS

| | | | | |
|---|---|---|---|---|
| 4,027,062 | A | | 5/1977 | Engelbrecht et al. |
| 4,103,047 | A | | 7/1978 | Zaki et al. |
| 4,147,851 | A | | 4/1979 | Raynolds |
| 4,595,518 | A | | 6/1986 | Raynolds et al. |
| 4,724,095 | A | | 2/1988 | Gresser |
| 4,742,140 | A | | 5/1988 | Greenwood et al. |
| 4,833,006 | A | | 5/1989 | McKinney et al. |
| 4,920,000 | A | * | 4/1990 | Green ..... 442/189 |
| 5,019,281 | A | | 5/1991 | Singer et al. |
| 5,047,065 | A | | 9/1991 | Vogel et al. |
| 5,153,046 | A | | 10/1992 | Murphy |
| 5,350,795 | A | | 9/1994 | Smith et al. |
| 5,532,023 | A | | 7/1996 | Vogel et al. |
| 5,573,695 | A | | 11/1996 | Targosz |
| 5,674,961 | A | | 10/1997 | Fitzgerald |
| 5,698,138 | A | | 12/1997 | Visca et al. |
| 5,855,985 | A | | 1/1999 | O'Donnell |
| 5,910,557 | A | | 6/1999 | Audenaert et al. |
| 6,024,823 | A | | 2/2000 | Rubin et al. |
| 6,033,705 | A | | 3/2000 | Isaacs |
| 6,043,209 | A | | 3/2000 | Micciche et al. |
| 6,075,003 | A | | 6/2000 | Haq et al. |
| 6,159,548 | A | | 12/2000 | Moody |
| 6,165,545 | A | | 12/2000 | Moody |
| 6,180,740 | B1 | | 1/2001 | Fitzgerald |
| 6,180,741 | B1 | | 1/2001 | Yamaguchi et al. |
| 6,251,210 | B1 | | 6/2001 | Bullock et al. |
| 6,297,209 | B1 | | 10/2001 | Kaaret et al. |
| 6,326,447 | B1 | | 12/2001 | Fitzgerald |
| 6,379,753 | B1 | | 4/2002 | Soane et al. |
| 6,413,925 | B2 | | 7/2002 | Akbarian et al. |
| 6,478,981 | B2 | | 11/2002 | Fitzgerald |
| 2002/0122890 | A1 | | 9/2002 | Linford et al. |
| 2003/0116744 | A1 | | 6/2003 | Kimbrell |
| 2004/0000013 | A1 | | 1/2004 | Lim |

FOREIGN PATENT DOCUMENTS

| | | |
|---|---|---|
| EP | 0 920 486 | 6/1997 |
| EP | 0 966 513 | 12/1999 |
| WO | WO 94/22595 | 10/1994 |
| WO | WO 02/06433 | 1/2002 |
| WO | WO 02/06580 | 1/2002 |

* cited by examiner

*Primary Examiner*—Vasu Jagannathan
*Assistant Examiner*—Preeti Kumar
(74) *Attorney, Agent, or Firm*—The Firenza Group Ltd.; Sharon R. Kantor

(57) ABSTRACT

A fabric treatment composition that includes at least one zeta potential modifier and a hydrophobic agent with a melting point or glass transition temperature below 100° C. that imparts fabric protection benefits, including improved stain and soil resistance, oil repellency, water repellency, softness, wrinkle and damage resistance, and better handfeel to treated fabrics. Treatment compositions can be used as a pretreatment prior to washing, through soaking, or added to the treatment liquor, that is either the wash or rinse cycle of an automatic washing machine, to first provide and then maintain and restore the beneficial fabric protection benefits imparted to the fabrics during a first treatment operation. The fabric treatment is complete when the fabric is cured by drying and/or heating. Following use of a first treatment composition, protective benefits are maintained and restored by means of a second treatment operation employing a second treatment composition with lower active levels of the protective agents to provide for economical and continual maintenance of the imparted fabric protection benefits through a delivered second fabric treatment benefit with each subsequent treatment operation employing the fabric treatment compositions.

20 Claims, No Drawings

FABRIC TREATMENT FOR STAIN RELEASE

CROSS-REFERENCE TO RELATED APPLICATIONS

This application claims the benefit of U.S. Provisional application filed Apr. 9, 2002, Ser. No. 60/371,452, and of U.S. Patent application filed Jan. 8, 2003, Ser. No. 10/338,350, and of U.S. Patent application filed Mar. 22, 2004, Ser. No. 10/806,850, all of which are hereby incorporated by reference.

FIELD OF THE INVENTION

The present invention relates to a fabric treatment composition for imparting fabric protection benefits, including stain and soil resistance, oil repellency, water repellency, softness, wrinkle and damage resistance, and improved handfeel. The composition can be used as a pretreatment prior to washing, through soaking or direct spray application, or added to a treatment cycle, such as the wash or rinse cycle of an automatic washing machine. The fabric treatment is complete when the fabric is cured by drying and/or heating.

BACKGROUND OF THE INVENTION

Most textile treatment agents for stain release, water repellency and oil repellency currently require industrial baths with high concentrations of chemicals followed by curing at high temperatures (substantially above 100° C.) often in commercial drying ovens. For example, U.S. Pat. No. 6,251,210 to Bullock et al. discloses a dual system consisting of a first treatment with at least 5 weight % fluorochemical textile agent followed by at least one secondary treatment with at least 4 weight % fluorochemical textile agent. The textile agent comprises, in addition to the fluorochemical, a urethane latex, a compatible acrylate latex and a cross-linking resin. The first treatment uses a low solids latex having a glass transition temperature from 10° C. to 35° C. The second treatment is a high solids latex having the consistency of wood glue or wallpaper paste, applied to one side of the fabric, and having a glass transition temperature from −40° C. to −10° C. This combined commercial treatment system is to produce a fabric that is liquid repellent, stain resistant, and is easy to handle.

U.S. Pat. No. 5,047,065 to Vogel et al. describes the combination of a perfluoroaliphatic group-bearing water/oil repellent agent dispersion, an emulsifiable polyethylene dispersion, and a soft-hand extender based on a modified hydrogen alkyl polysiloxane. The compositions are padded onto fabric at a concentration of 70-150 g/L and then cured at 150° C.

U.S. Pat. No. 5,019,281 to Singer et al. describes the combination of a water-soluble $C_9$-$C_{24}$ quaternary ammonium salts of alkyl phosphonic acid, a separate $C_{12}$-$C_{24}$ quaternary ammonium compound, and a dispersed polyethylene wax. The compositions are padded onto fabric at a concentration of 30 g/L and then cured at 110° C.

U.S. Pat. No. 5,153,046 to Murphy describes the combination of fluorochemical textile antisoilant, lubricant, and combination of cationic and nonionic surfactants. The compositions are intended for commercial application to nylon yarns.

Water-proofing has traditionally been performed with solvent-based wax and wax-like coating commonly using paraffin wax, chlorinated paraffin waxes, and ethylene/vinyl acetate waxes such as those materials cited in U.S. Pat. No. 4,027,062 to Englebrecht et al. and U.S. Pat. No. 4,833,006 to McKinney et al. It is also possible to make fabrics liquid resistant by using silicone materials commonly known in the art.

Some technologies have been developed to provide a fabric benefit on direct application or as an ironing aid. For example, U.S. Pat. No. 5,532,023 to Vogel et al. describes the post-wash use of silicones and film-forming polymer for use on damp or dry clothing to relax wrinkles. The composition is sprayed on the fabric and then ironed or stretched by hand for wrinkle reduction benefit. There is no indication that the composition can be applied in the wash.

Products that are applied directly on the fabric, for instance by spraying followed by curing with an iron or in a hot dryer at high temperatures, such as above 100° C., suffer several disadvantages. Usually, a thick or uneven coat results, which gives areas of incomplete oil and water repellency and a fabric hand feel that lacks softness. These products can also decrease the porosity of fabric, resulting in uncomfortable conditions for the wearer during use. An additional drawback of direct application products is that they cannot be used on fabrics that are already stained or soiled because they lock in stains and soils.

Fluoropolymers and hydrophobic agents have previously been suggested for laundry use. U.S. Pat. No. 6,075,003 to Haq et al. disclose the use of fluoropolymers with cationic fabric softeners. U.S. Pat. No. 5,910,557 to Audenaert et. al. discloses the use of fluorochemical polyurethane compounds to impart oil and water repellency. These patents do not suggest the additional use of hydrophobic agents with fluoropolymers in the wash for combined oil and water repellency, while maintaining a soft hand. The use of generally less expensive hydrophobic agents, such as wax, allows products whose value is more acceptable to the consumer.

U.S. Pat. No. 6,180,740 to Fitzgerald describes an aqueous emulsion containing a fluorocopolymer composition that provides oil-and water-repellency to textiles. The composition is apparently stable under conditions of high alkalinity, high anionic concentration, and/or high shear conditions. The stability of emulsions having either positive or negative zeta potentials is said to be achieved by controlling the relative amounts of cationic and anionic surfactants. Emulsions with a positive zeta potential are desirable for applications where the emulsion is used to apply a coating to textile fabrics, which are typically anionic in character. Fabric treatment requires drying at relative high temperatures of between 110° C. to 190° C.

U.S. Pat. No. 6,379,753 to Soane et al. describes methods for modifying textile materials to render them, for example, water repellant by covalently bonding multifunctional molecules to the textile material. The multifunctional molecules are polymers with plural functional groups or regions, such as binding groups, hydrophobic groups, and hydrophilic groups and oleophobic groups.

As can be seen there is a need for a product that offers the controlled and even coating of commercial treatment operations with the convenience and ease of home use. Additionally the coating should be cured at temperatures that are attainable in commonly available residential dryers as curing at high temperatures makes the coating excessively durable typically resulting in an unfavorable handfeel owing to excessive build up over numerous treatment cycles. Furthermore, the reduced temperature curing results in not only improved handfeel, it allows for an easily reversible and/or removable coating. Such a transient coating reduces coating build up over multiple applications or treatments that result in poor handfeel, and also reduces the potential for leaving a visible residue or causing all undesirable changes in appearance, such as yellowing or discoloration of white or lighted colored fabrics. The product should also not lock in pre-existing stains or soils and thereby ruin fabrics, including clothes.

SUMMARY OF THE INVENTION

The present invention is based in part on the discovery that compositions containing at least one zeta potential modifier and a hydrophobic agent when applied to fabrics and cured by drying and/or heating will impart numerous fabric protection benefits, including stain resistance, oil repellency, water repellency, softness, wrinkle and damage resistance, and improved handfeel. Fabric protection benefits include minimizing fiber wear (e.g., retaining fiber tensile strength), maintaining fabric appearance by reducing fiber pilling, and/or reducing color loss, and/or inhibiting the deposition of fugitive dyes onto the fabric during a washing process. These benefits, individually and collectively, increase the useful longevity of the treated garment or fabric. Preferred fabric treatment compositions also include a fluoropolymer.

In one aspect, the invention is directed to a method of treating fabrics in a washing machine to provide first fabric protective properties and subsequent second fabric protective properties to a fabric, comprising the steps of:

(1) depositing a first composition onto the fabric in a first treatment liquor wherein the first composition comprises a hydrophobic agent having a melting point or glass transition temperature of less than 100° C., a fluoropolymer and an effective amount of a zeta potential modifier so that the first treatment liquor has a zeta potential that is positive and greater than zero millivolts; and (2) first curing said fabric at a temperature above ambient temperature but less than 100° C.;

(3) depositing a second composition onto the fabric in a second treatment liquor wherein the second composition comprises a hydrophobic agent having a melting point or glass transition temperature of less than 100° C. and an effective amount of a zeta potential modifier so that the second treatment liquor has a zeta potential that is positive and greater than zero millivolts; and (4) subsequently curing said fabric at a temperature above ambient temperature but less than 100° C.; wherein said first fabric protective properties comprise increased water repellancy, increased oil repellancy, improved handfeel, improved softness, improved resistance to damage, and any combination thereof; and wherein said second fabric protective properties comprise at least one of said first fabric protective properties; wherein said hydrophobic agent is not a fluoropolymer; and wherein the ratio of hydrophobic agent to zeta potential modifier is greater than or equal to 1:3.

DETAILED DESCRIPTION OF THE INVENTION

The present invention is directed to a method of treating fabrics in a washing machine to provide first fabric protective properties and subsequent second fabric protective properties to a fabric, comprising the steps of: (1) depositing a first composition onto the fabric in a first treatment liquor wherein the first composition comprises a hydrophobic agent having a melting point or glass transition temperature of less than 100° C., a fluoropolymer and an effective amount of a zeta potential modifier so that the first treatment liquor has a zeta potential that is positive and greater than zero millivolts; and (2) first curing said fabric at a temperature above ambient temperature but less than 100° C.; (3) depositing a second composition onto the fabric in a second treatment liquor wherein the second composition comprises a hydrophobic agent having a melting point or glass transition temperature of less than 100° C. and an effective amount of a zeta potential modifier so that the second treatment liquor has a zeta potential that is positive and greater than zero millivolts; and (4) subsequently curing said fabric at a temperature above ambient temperature but less than 100° C.; wherein said first fabric protective properties comprise increased water repellancy, increased oil repellancy, improved handfeel, improved softness, improved resistance to damage, and any combination thereof, and wherein said second fabric protective properties comprise at least one of said first fabric protective properties; wherein said hydrophobic agent is not a fluoropolymer; and wherein the ratio of hydrophobic agent to zeta potential modifier is greater than or equal to 1:3.

The present direction is also directed to a method of treating a fabric article in a washing machine to provide a first fabric protective property and a subsequent second fabric protective property to said fabric article, comprising the steps of: (1) contacting a first composition with said fabric article in a first treatment liquor; wherein said first composition comprises:

a. 0.5 to 60 weight % of a hydrophobic agent;

b. 5 to 30 weight % of a fluoropolymer; and c. an effective amount of a zeta potential modifier so that said first treatment liquor has a zeta potential that is positive and greater than zero millivolts; and (2) first curing said fabric article at a temperature above ambient temperature but less than 100° C.; (3) contacting a second composition with said fabric article in a second treatment liquor; wherein said second composition comprises:

a. hydrophobic agent at a weight % level less than that present in said first composition;

b. an effective amount of a zeta potential modifier so that said second treatment liquor has a zeta potential that is positive and greater than zero millivolts;

(4) subsequently curing said fabric article at a temperature above ambient temperature but less than 100° C. wherein said first fabric protective property comprises a property selected from the group consisting of increased water repellancy, increased oil repellancy, improved handfeel, improved softness, improved resistance to damage, and combinations thereof, and wherein said second fabric protective property comprises at least one of said first fabric protective property; wherein said hydrophobic agent is not a fluoropolymer; and wherein the ratio of hydrophobic agent to zeta potential modifier is greater than or equal to 1:3.

The present invention is also directed to a kit and use of a kit wherein such kit comprises a first treatment composition and a second treatment composition for treating a fabric article in a washing machine producing a first treatment liquor providing a first fabric protective property and producing a second treatment liquor providing a second fabric protective property to said fabric article;

wherein said first treatment composition comprises:

a. 5 to 10 weight % of a first hydrophobic agent;

b. 5 to 30 weight % of a fluoropolymer; and c. an effective amount of a zeta potential modifier so that said first treatment liquor has a zeta potential that is positive and greater than zero millivolts;

wherein said second treatment composition comprises:

a. a second hydrophobic agent at a weight % level less than the level of said first hydrophobic agent present in said first composition; and b. an effective amount of a zeta potential modifier so that said second treatment liquor has a zeta potential that is positive and greater than zero millivolts;

wherein said first hydrophobic agent and second hydrophobic agent are independently selected from the group consisting of hydrophobic waxes, polymers produced from ethylenically unsaturated monomers, low molecular weight polyethylene, low density polyethylene, polypropylene, oxidized polyethylene, oxidized polypropylene, polyolefin, polyurethane, ethyl vinyl acetate, polyvinyl chloride, co-polymers, emulsifiable waxes, and mixtures thereof; wherein the ratio of said first and said second hydrophobic agent to said zeta potential modifier in said respective first and second composition is greater than or equal to 1:3; and wherein said first fabric protective property and said second fabric protective property are achieved by the steps comprising:

(1) contacting said fabric article with either said first or said second treatment liquor; and (2) subsequently curing said fabric article at a temperature above ambient temperature but less than 100° C.

Fluoropolymer

According to the present invention, the fluoropolymers as prepared may contain some amount of surfactants, especially mixtures of cationic and nonionic surfactants, but usually the amounts are small. A preferred range for fluoropolymers is 0.5 to 60%, more preferred is I to 40%, and further preferred is 5 to 30%.

The fluoropolymers employed in the present invention can be water insoluble oily soil repellents and may have one or more fluoroaliphatic radicals, and/or one or more perfluoroalkyl radicals and/or partially or fully fluorinated radical substituents. They can be nonionic in that they do not contain an ionized functional group such as a quaternary ammonium group. They can be cationic in that they contain an ionized or ionizable functional group, such as a quaternary ammonium group in the first instance, or a tertiary amine which is protonatable to provide for a positive charge center. They can be zwitterionic in that they have both cationic and anionic groups present, suitably with the number of cationic and anionic groups present being essentially equivalent in number to provide an overall net nonionic property to the fluoropolymer, and also suitably with the number of cationic and anionic groups present being essentially non-equivalent in number to provide an overall net positive or cationic charge to the fluoropolymer. Useful classes of the fluoropolymers are the fluorocarbonylimino biurets, the fluoroesters, the fluoroester carbamates, and the fluoropolymers. The class of fluorocarbonylimino biurets is represented by U.S. Pat. No. 4,958,039 to Pechhold, which is incorporated herein by reference. The class of fluorocarbonylimino biurets is particularly useful because of the outstanding antisoilant protection it provides. The class of fluoroesters is represented by U.S. Pat. No. 3,923,715 to Dettre et al. and U.S. Pat. No. 4,029,585 to Dettre et al., which are incorporated herein by reference. These patents disclose perfluoroalkyl esters of carboxylic acids of 3 to 30 carbon atoms. An example is the citric acid ester of perfluoroalkyl aliphatic alcohols such as a mixture of 2-perfluoroalkyl ethanols containing 8 to 16 carbon atoms. The class of fluoroester carbamates is also disclosed in aforementioned U.S. Pat. No. 4,029,585. The class of fluoropolymers is represented by U.S. Pat. No. 3,645,989 to Tandy and U.S. Pat. No. 3,645,990 to Raynolds, which are incorporated herein by reference. The patents describe, respectively, fluorinated polymers from acrylic and methacrylic derived fluoro-substituted monomers and methyl acrylate or ethyl acrylate, optionally with small amounts of other monomers.

A useful fluoropolymer is the terpolymer formed by polymerization of an aliphatic or aromatic alpha olefin or an alkyl vinyl ether, a non-hydrolyzable perfluoroalkyl substituted monomer and maleic anhydride as described in U.S. Pat. No. 6,245,116 to Pechhold et al which is incorporated herein by reference. Useful fluoropolymers are ZONYL 8412 and ZONYL RN available from Ciba-Geigy; SCOTCHGARD FC 255, SCOTCHGARD FC 214-230, FLUORAD series, such as FLUORAD FC 129, available from the 3M Corporation (Minnesota Mining and Manufacturing Company, St. Paul, Minn.); and TEFLON RN, TEFLON 8070, and TEFLON 8787, available from Dupont. Additional useful fluoropolymers include ZONYL 7950, ZONYL 5180, ZONYL 6885, ZONYL 7910, ZONYL 6700, ZONYL 8300, ZONYL 6991, ZONYL 310 and ZONYL NWG, all from Dupont. Useful fluoropolymers also include fluoropolymers available from Asahi Glass, Atochem (Atofina), Daikin, Clariant, Goldschmidt, Hoechst Celanese, Mitsubishi, Peach State Laboratories, Shaw Industries and Trichromatic Carpet. Examples include the FOMBLIN FE-20 series of aqueous based perfluoro polyether microemulsions (available from Ausimont USA, Thorofare, N.J.), fluoropolymer emulsion 3310, 3311 and Unidyne® TG-532 (available from Daikin Industries Ltd., Japan), fluoropolymer emulsions NUVA 5006, NUVA LB Liquid, NUVA LC Liquid (available from Clariant Corporation, Charlotte, N.C.), fluoropolymer REPEARL F-45 (available from Mitsubishi International Corporation, NY) and MYAFIX WS and MYAFIX EX.WS (available from Peach State Labs, Rome, Ga.). Other examples include NUVA FT fluorochemical acrylate polymer (available from Clariant Corporation), SHAWGUARD 353 fluoroalkyl acrylate copolymer (available from Shaw Industries, Inc.) and BARTEX TII, BARTEX MAC, both fluoroalkyl acrylate polymers (available from Trichromatic Carpets, Inc., Quebec, Canada).

Highly preferred materials of this class of fluoropolymers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Hydrophobic agent

A preferred range for hydrophobic agents is 0.5 to 60%, more preferred is 1 to 40%, and further preferred is 5 to 30%.

The hydrophobic agent compounds of the invention include those which are at least partly insoluble in water at a temperature of 20° C. and which have a melting point or glass transition temperature below 100° C. and preferably between about 45° C. to below 100° C. Suitable hydrophobic agents include hydrophobic polymer, copolymers, and copolymers containing hydrophobic monomers. Suitable hydrophobic agents include hydrophobic waxes, including, but not limited to paraffin waxes. The paraffin waxes suitable for use in accordance with the invention are generally complex mixtures without a clear-cut melting point. For characterization purposes, their melting range is normally determined by differential thermoanalysis (DTA), as described in "The Analyst" 87 (1962), 420, and/or by their solidification point. This is understood to be the temperature at which the wax changes from a liquid into a solid state through slow cooling. According to the invention, both paraffins can be completely liquid at room temperature, i.e. those with a solidification point below 25° C., and paraffins solid at room temperature may be used. The paraffin wax is preferably solid at room temperature and can be present in completely liquid form at 100° C. Suitable paraffin waxes for use in accordance with the invention may be obtained, for example, under the name of LUNAFLEX from Fuller and under the name of DEAWAX from DEA Mineralöl AG.

Other suitable hydrophobic agents are produced from ethylenically unsaturated monomers. Examples of such monomers are styrene, acrylic acid or methacrylic acid esters of aliphatic $C_1$ to $C_{18}$ alcohols, acrylonitrile, vinyl acetate, acrylic acid and methacrylic acid. Poly(meth)acrylates of two or more of these monomers, which may optionally contain other monomers in small quantities, are particularly preferred. Most particularly preferred polymers contain 1 to 30 parts by weight of monomers containing carboxylic acid groups; 30 to 70 parts by weight of monomers which form homopolymers having glass temperatures below 20° C., preferably esters of acrylic acid with $C_1$ to $C_{18}$ alcohols and/or methacrylic acid with $C_1$ to $C_{18}$ alcohols; and 30 to 70 parts by weight of monomers which form homopolymers having glass transition temperatures above room temperature, preferably methacrylic acid esters of $C_1$ to $C_3$ alcohols or styrene. Examples of such polymers include the following commercial products that are available as dispersions: SYNTRAN 1501 (Interpolymer), PRIMAL 644 (Rohm & Haas), NEOCRYL A 1049 (ICI). Other preferred polymers include low molecular weight (below 500,000) polyethylene, low density polyethylene, polypropylene, polyolefin, polyurethane, ethyl vinyl acetate, polyvinyl chloride, and co-polymers.

Another class of suitable hydrophobic agents are emulsifiable waxes. Emulsifiable waxes, capable of forming wax emulsions, include, for example, oxidized polyethylene, ethylene acrylic acid copolymers, and montanic acid and ester waxes available as LUWAX. Also suitable are polyolefin waxes, maleic grafted polyolefin waxes, paraffin, other hydrocarbon waxes and vegetable waxes such as camauba and candelillia. Preferred emulsifiable waxes include polyethylene, polypropylene, oxidized polyethylene, oxidized polypropylene, ethylene acrylic copolymers, and maleic grafted polyolefins. Preferred emulsifiable waxes include polyolefin that is partially modified to contain functional groups improving dispersability of the waxes, such functional groups including alkoxyl, carboxyl, amide, alkylamide, sulfonic, phosphonic or mixtures thereof. These also include waxes containing chemical groups which facilitate emulsification such as carboxylic or related groups. Examples of emulsifiable waxes include oxygen-containing wax or oxidized waxes as illustrated by those described in the following patents: natural waxes such as candelillia, camauba, beeswax, coconut wax, montan wax, as well as oxidized petroleum waxes as illustrated by U.S. Pat. No. 2,879,237 to Groote et al., U.S. Pat. No. 2,879,238 to Groote et al., U.S. Pat. No. 2,879,239 to Groote et al., U.S. Pat. No. 2,879,240 to Groote et al., and U.S. Pat. No. 2,879,241 to Groote et al., U.S. Pat. No. 3,163,548 to Stark, and U.S. Pat. No. 4,004,932 to Bienvenu, which are incorporated herein by reference. Other examples include carboxylic adducts such as maleic and related anhydrides added to waxes such as those described in the following U.S. Pat. No. 3,933,511 to Heintzelman et al., and U.S. Pat. No. 3,933,512 to Heintzelman et al., which are incorporated herein by reference. Typical examples are esters, amides, and ester-amides of compositions of one or more of the formulas disclosed in U.S. Pat. Nos. 3,933,511 and 3,933,512 which are incorporated herein by reference. Some of these waxes are sold by Petrolite Corporation under the name CERAMER.

Other preferred waxes may be, for example, alkyl methycone AMS-C30 (Dow Corning), natural candelillia (Candelillia from Frank B. Ross), stearyoxyytrimethylsilane 580 wax (Dow Corning), cetyl palmitate DUB PC Stearine (Dubois), microcrystalline/petrolatum MULTIWAX B710 (Witco), Scale paraffin (Strahl and Pitsch), natural beeswax (Frank B. Ross), microcrystalline (Ultraflex Petrolite), microcrystalline Ross wax 1329/1 (Frank B. Ross), microcrystalline Multiwax 110X (Witco), paraffin (Altafin 135/140), petrolatum (Petrolatum Snow from Penreco), refined paraffin (Strahl and Pitsch), and paraffin Altafin 125/130. Preferably, the low melting point wax is selected from microcrystalline Multiwax W145A (Witco), paraffin (Altafin 140/145 from Astor-Durachem), and microcrystalline Ross wax 1365 (Frank B. Ross). Highly preferred materials of this class of hydrophobic agents are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Liquid Carrier

The liquid carrier is preferably an aqueous system. The carrier can also contain a low molecular weight organic solvent that is highly soluble in water, e. g., $C_1$ to $C_4$ monohydric alcohols, $C_2$ to $C_6$ polyhydric alcohols, such as alkylene glycols and polyalkylene glycols, alkylene carbonates, and mixtures thereof. Examples of these water-soluble solvents include ethanol, propanol and isopropanol. Water is a preferred liquid carrier due to its low cost, availability, safety, and environmental compatibility. The water can be distilled, deionized, or tap water.

Highly preferred materials of this class of liquid carriers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure. When a concentrated composition is used, the level of liquid carrier can typically be from about 20% to about 80% of the composition, preferably from about 30% to about 70%, and more preferably from about 40% to about 60% of the composition. When a dilute composition is used, for instance in a rinse added maintenance or spray application, the amount of liquid carrier can be greater. For rinse added maintenance applications, the liquid carrier may typically range from about 50% to about 99% of the composition, preferably from about 60% to about 98%, and more preferably from about 80% to about 95% of the composition. For direct applications, employing the inventive compositions in "neat form", that is to say, undiluted form and such as for spray and aerosol applications, the liquid carrier can typically range from about 70% to about 99.9%, by weight of the composition, preferably from about 80% to about 99.5%, and more preferably from about 90% to about 99% of the composition. When used in direct treatment, that is in the form of an undiluted composition (a "neat composition") that does not require any subsequent dilution for use, levels of the inventive composition are necessarily reduced to the required level for effectiveness.

Zeta Potential Modifier

Compositions of the present invention include fluoropolymers and hydrophobic agents that become covalently and/or non-covalently attached to the surface of fabrics upon being cured at elevated temperatures. There is a wide range of phenomena which can influence the fundamental interactions at the molecular and colloidal level. One of these factors is the electrokinetics. In this regard, the term, zeta potential, applies to the electrical charges existing in fine dispersions. Specifically, a solid particle, e.g., insoluble polymer, that is suspended in an aqueous system is surrounded by a dense layer of ions having a specific electrical charge. This layer is surrounded by another layer, more diffuse than the first, that has an electrical charge of its own. The bulk of the suspended liquid also has its own electrical charge. The difference in electrical charge between the dense layer of ions surrounding the particle and the bulk of the suspended liquid is the zeta potential, usually measured in millivolts. The zeta potential, ξ, is defined by the equation:

$$\xi=4\pi\delta q/D$$

where q is the charge on the particle, δ is the thickness of the zone of influence of the charge on the particle, and D is the dielectric constant of the liquid.

Without being bound by theory, it is believed that the fluoropolymers are attracted to the fabric surface owing to a combination of van der Waals attractive forces and electrostatic interactions. In the case of treating fabrics containing cellulose fibers, e.g., cotton, the surface of the fabric is negatively charged due to the presence of the carboxylic groups of the cellulose. In the case of treating fabrics containing synthetic fibers, such as polyester, nylon, polyamide and other synthetic polymers or blends, adsorbed materials such as negative compounds or negatively charged surface active materials, e.g., anionic surfactants found in detergents, can result in the surface of the fabric becoming negatively charged due the presence of these materials on the fabric surface. Without being bound by theory, it is believed that the existence of negatively charged groups or adsorbed negatively charged materials on the fabric surface may inhibit the attraction of the fluoropolymers to the fabric surface to at least to some extent.

It is believed that the adverse effect of any negative surface charge present on fabrics to be treated, regardless of the cause or source of said negative surface charge, can be reduced or avoided by introducing an appropriate amount of zeta potential modifier to adjust the zeta potential of the treatment liquor to a positive value greater than zero. Typically sufficient zeta potential modifier is added so that the zeta potential of the treatment liquor is positive and greater than zero millivolts. Preferably the zeta potential of the treatment liquor ranges from a positive value of zero to about +150 millivolts and preferably is less than about +100 millivolts. When at least one zeta potential modifier is employed, it will typically range from 0.1 to 30% of the composition. It has been found that exceeding this level leads to decreased performance. Without being bound by theory, it is believed that exceeding this level of zeta potential modifier leads to interference in depositing the desired repelling species. This discovery distinguishes the invention from prior art that employs zeta potential modifiers, given that the levels in the instant invention are dictated by efficacy of the treatment liquor, not for stabilization of the composition.

Suitable zeta potential modifiers are cationic agents including, for example, cationic monomers, polymers, and copolymers comprising cationic monomers, wherein the cationic monomer is present at least to an extent sufficient to provide an overall net cationic nature, i.e. overall positive charge, to the copolymer. Preferred cationic agents include cationic surfactants, including, but not limited to, mono and di-methyl fatty amines, alkyl trimethyl ammonium salts, dialkyl dimethyl ammonium salts, alkyl amine acetates, trialkylammonium acetates, alkyldimethylbenzyl ammonium salts, dialkymethylbenzyl ammonium salts, alkylpyridinium halide and alkyl (alkyl substituted) pyridinium salts, alkylthiomethylpyridinium salts, alkylamidomethylpyridinium salts, alkylquinolinium salts, alkylisoquinolinium salts, N,N-alkylmethylpyrollidonium salts, 1,1-dialkylpiperidinium salts, 4,4-dialkylthiamorpholinium salts, 4,4-dialkylthiamorpholinium-1-oxide salts, methyl bis (alkyl ethyl)-2-alkyl imidazolinium methyl sulfate (and other salts), methyl bis(alkylamido ethyl)-2-hydroxyethyl ammonium methyl sulfate (and other salts), alkylamidopropyl-dimethylbenzyl ammonium salts, carboxyalkyl-alkyldimethyl ammonium salts, alkylamine oxides, alkyldimethyl amine oxides, poly(vinylmethylpyridinium) salts, poly(vinylpyridine) salts, polyethyleneimines, trialkyl phosphonium bicarbonates (and other salts), trialkylmethyl phosphonium salts, alkylethylmethylsulfonium salts, and alkyldimethylsulfoxonium salts.

Suitable zeta potential modifiers further include cationic (i.e. bearing one or more positive charges) and cationically modified materials, including, for example, cationic and cationically modified organic polymers, cationic and cationically modified biopolymers, and cationic and cationically modified inorganic materials, including, for example, cationic and cationically modified clays, silicas, metal oxides and composite materials.

Suitable organic cationic polymers include, but are not limited to, cationic cellulose derivatives, such as, for example, a quaternized hydroxyethylcellulose which is available under the name Polymer JR 400® from Amerchol, cationic starch, copolymers of diallylammonium salts and acrylamides, quaternized vinylpyrrolidone/vinylimidazole polymers, such as, for example, Luviquat® (BASF), condensation products of polyglycols and amines, quaternized collagen polypeptides, such as, for example, lauryldimonium hydroxypropyl hydrolyzed collagen (Lamequat®L/Grunau), quaternized wheat polypeptides, polyethyleneimine, cationic silicone polymers, such as, for example, amodimethicones, copolymers of adipic acid and dimethylaminohydroxypropyldiethylenetriamine (Cartaretins®/Sandoz), copolymers of acrylic acid with dimethyldiallylammonium chloride (Merquat(D550/Chemviron), polyaminopolyamides, as described, for example, in FR 2252840 A, and their crosslinked water-soluble polymers, condensation products of dihaloalkyls, such as, for example, dibromobutane with bisdialkylamines, such as, for example, bisdimethylamino-1, 3-propane, cationic guar gum, such as, for example, Jaguar® CBS, Jaguar® C-17, Jaguar® C-16 from Celanese, guar guar (e.g. guarhydroxypropyltrimethylammonium chloride; Cosmedia Guar C 261; Cognis GmbH; guar flour; Cosmedia Guar U, Cognis GmbH), quaternized ammonium salt polymers, such as, for example, Mirapol® A-15, Mirapol® AD-1, Mirapol® AZ-1 from Miranol, and cationically modified starches, as for example, Softgel BDA and Softgel BD, both from Avebe.

Additional cationic compounds suitable for use as zeta potential modifiers include amine acid salts; polyacryamidopropyltrimmonium chloride; betaines, such as but not limited to, alkyl betaines, alkyl amido betaines, imidazolinium betaines; quaternized poly(vinylpyridine); amidoamine acid salts; poly(imine) acid salts; polyethylene imine acid salts;

cationic polyacryamides; poly(vinylamine) acid salts; cationic ionene polymers; poly(vinylimidazolinium salts); quaternized silicone compounds, such as but not limited to, the diquaternary polydimethylsiloxanes; poly(vinyl alcohol) quaternary materials; polydimethyldiallylammonium chloride; cationic exchange resins; anionic exchange resins; copolymers of vinylpyrrolidone and methyacrylamidopropyltrimethylammonium chloride; acidified polyvinylpolypyrrolidones; acidified copolymers of vinylpyrrolidone and vinylacetate; acidified copolymers of vinylpyrrolidone and dimethylaminoethylmetacrylate; copolymers of vinylpyrrolidone and methacrylamidopropyl trimethlyammonium chloride; copolymers of quaternized vinylpyrrolidone and dimethylaminoethylmethacrylate; acidified copolymers of vinylpyrrolidone and styrene; acidified copolymers of vinylpyrrolidone and acrylic acid, and cationic polyelectrolyte polymers.

Suitable organic cationic inorganic materials suitable for use as zeta potential modifiers include, but are not limited to cationic clay, such as for example, sodium montmorillonite, hydrotalcite, vermiculite, kaolinite; clays reacted with quaternary compounds, such as, tetramethylammonium chloride; polyquarternized amines; acidified n-alkyl-2-pyrrolidones; polyacrylic acid polymers; alkyl C8 to alkyl C24 organic acids, such as but not limited to, lauric acid, stearic acid; and combinations thereof.

Suitable metal oxides and composites include cationically modified metal oxides and layered metal oxide composites, for example, but not limited to, oxides of silicon, germanium, selenium, chromium, titanium, aluminum, gallium, nickel, iron, copper, silver, gold, platinum, magnesium and calcium, and mixtures and/or layered composites thereof.

Suitable zeta potential modifiers further include cationically modified silicas, such as those disclosed in U.S. App. No. 20030157804, which is incorporated herein by reference.

Suitable zeta potential modifiers further include chitosans, which are cationic biopolymers under the pH conditions, and cationic chitin derivatives, such as, for example, quaternized chitosan, optionally in microcrystalline distribution. Examples are disclosed in Ullmann's Encyclopedia of Industrial Chemistry, 5th Ed., Vol. A6, Weinheim, Verlag Chemie, 1986, p. 231-232, which is incorporated herein by reference.

Preferred forms of the zeta potential modifiers described herein include water soluble, water dispersible and water insoluble suspensions, dispersions or emulsions of these zeta potential modifiers. Preferred forms of the inorganic and polymeric based zeta potential modifiers include fine particulates for improved dispersibility in the compositions of the present invention. Preferred forms of the inorganic and polymeric zeta potential modifiers include particulates having particle sizes in the micron and nanometer size ranges. Preferred sizes of particulates, for example, include particle sizes in the range of about 1 nanometer to about 100 microns, most preferred being particle sizes in the range of about 1 nanometer to about 1 microns.

It should be noted that the source of the zeta potential modifiers is not critical. Thus, as further demonstrated herein, commercially available fabric softeners that include cationic surfactants can be employed as a source of zeta potential modifiers. Thus, the fabric softener serves multiple functions including facilitating the attachment of the fluoropolymers and hydrophobic agents to the fabric surface. Further, multivalent cationic salts, including cations of the alkaline earth metals (Group IIA), transition metals (Groups IIB, IVB, VB, VIB, VIIB, VIIIB, IB, IIB, IIA, IVA) and non-metal elements (Groups IVA, VA) may be appropriate for use as zeta potential modifiers alone, combined together, or in combination with other zeta potential modifiers described herein.

It should further be noted that the zeta potential modifiers are included as optional ingredients of the fabric treatment composition as discussed herein. Thus when the composition is formulated for use as a treatment not in the presence of another treatment aid, for example a detergent containing anionic surfactants, or when the composition is formulated for use as a direct fabric treatment, then the zeta potential modifiers are deemed optional in that they are not needed to counteract the negatively charged species, such as anionic surfactants found in commercial detergents, that might otherwise interfere to some extent with the attraction of the fluoropolymer to the fabric surface.

Highly preferred materials of this class of zeta potential modifiers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Optional Ingredients

Emulsifiers

The above fluoropolymers and hydrophobic agents may require the use of emulsifiers, such as ethoxylated fatty alcohols, fatty amides, fatty acids and alkylphenols and fatty amines or salts thereof. Other preferred emulsifiers include quaternary ammonium or protonated amine cationic surfactants such as trimethyl-dodecylammonium chloride, trimethyl-hexadecylanimonium chloride, dimethyl-dicocoammonium chloride, and dimethyl-octadecylammonium acetate. Preferred nonionic emulsifiers include the etherification products of ethylene oxide and/or propylene oxide with glycerol monooleate, oleic acid, cetyl alcohol, pelargonic acid, stearyl alcohol, sorbitan monooleate, sorbitan monostearate.

Highly preferred materials of this class of emulsifiers are those that do not cause any significant color change, nor impart any discoloration, such as graying or yellowing, to the fabrics to which they are applied, either during treatment followed by drying, or after the drying step followed by normal exposure to the elements, such as air, moisture or sunlight exposure.

pH Adjusters

The pH of a solution of compositions of this invention may be adjusted to be in the range from about 2 to about 11. Adjustment of pH may be carried out by including a small quantity of an acid in the formulation. Because no strong pH buffers need be present, only small amounts of acid may be required. The pH may be adjusted with inorganic or organic acids, for example hydrochloric acid or alternatively with monobasic or dibasic organic acids, such as acetic acid, maleic acid or in particular glycolic acid. Additional acids that can be used include, but are not limited to, methyl sulfonic, hydrochloric, sulfuric, phosphoric, citric, maleic, and succinic acids. Adjustment of pH may be carried out by including a small quantity of a base in the formulation. Because no strong pH buffers need be present, only small amounts of base may be required. The pH may be adjusted with inorganic bases, including, but not limited to, alkali metal or alkaline earth metal salts of hydroxides, carbonates, bicarbonates, borates, sulfonates, phosphates, phosphonates and silicates. The pH may be adjusted with organic bases, including, but not limited to, salts of monocarboxylic acids, salts of dicarboxylic acids, salts of citric acid and other suitable organic acids with water soluble conjugate bases presented previously herein. The pH may be adjusted with organic bases such as the alkanolamines including methanol, ethanol and propanol amines, including dimethanol, diethanol and dipropanol amines, and including trimethanol, triethanol and tripropanol amines.

Highly preferred materials of this class of pH adjusters are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Silicones

An optional silicone component can be used in an amount from about 0.1% to about 6% of the composition, preferably from 0.1 to 3% of the composition. These optional ingredients include silicones and organopolysiloxanes. In addition to the known dialkylpolysiloxanes, it is possible to use, in particular, hydrophilizing silicones, such as dimethylpolysiloxanes which contain incorporated epoxy groups and/or polyethoxy or polypropoxy or polyethoxy/propoxy groups. Preferred siloxanes include aminoethylaminopropyl dimethyl siloxane, hydroxy terminated dimethyl siloxane (dimethiconol), and modified hydrogen alkyl polysiloxanes. Preferred silicones comprise cationic and amphoteric silicones, polysiloxanes, and polysiloxanes having hydrogen-bonding functional groups consisting of amino, carboxyl, hydroxyl, ether, polyether, aldehyde, ketone, amide, ester, and thiol groups. Such polysiloxanes include, but are not limited to, polyether-modified polysiloxanes, amino-modified polysiloxanes, epoxy-modified polysiloxanes, polyhydrido-modified polysiloxanes, phenol derivative-modified polysiloxanes, ABA-type polysiloxanes, including those available from OSi Specialties, Inc. (a division of Witco Corporation), under the SILWET, NUWET, NUDRY, NUSOF, MAGNASOFT trade names. Preferred silicones may include polydimethylsiloxanes of viscosity from about 100 centistokes (cs) to about 100,000 cs, and preferably from about 200 cs to about 60,000 cs and/or silicone gums. These silicones can be used in emulsified form, which can be conveniently obtained directly from the suppliers. Examples of these preemulsified silicones are the 60% emulsion of polydimethylsiloxane (350 cs) sold by Dow Corning Corporation under the trade name DOW CORNING 1157 Fluid and the 50% emulsion of polydimethylsiloxane (10,000 cs) sold by General Electric Company under the trade name GENERAL ELECTRIC 2140 silicones. Silicone foam suppressants can also be used. These are usually not emulsified and typically have viscosities from about 100 cs to about 10,000 cs, and preferably from about 200 cs to about 5,000 cs. Very low levels can be used, typically from about 0.01% to about 1%, and preferably from about 0.02% to about 0.5%. Another preferred foam suppressant is a silicone/silicate mixture, for example, DOW CORNING ANTIFOAM A.

Highly preferred materials of this class of silicones are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Nonionic Surfactant

The composition can contain a nonionic surfactant. When a nonionic surfactant is added to the composition, it can typically be added at a level from about 0.05% to about 30%, preferably from about 0.05% to about 20%, and more preferably from about 0. 1% to about 10% of the composition.

Suitable nonionic surfactants include addition products of alkoxylating agents such as ethylene oxide (EO), propylene oxide (PO), isopropylene oxide (IPO), or butylene oxide (BO), or a mixture thereof, with fatty alcohols, fatty acids, and fatty amines. Any of the alkoxylated materials of the particular type described hereinafter can be used as the nonionic surfactant. Preferably, the nonionic surfactant is selected from the group consisting of alkylether carboxylate, alcohol ethoxylate or secondary alcohol ethoxylate, and alkyl phenyl ethoxylate or alkyl aryl ethoxylate. These nonionic surfactants may also contain a mixture of ethoxylate and propoxylate. Suitable alkylpolysaccharides for use herein are disclosed in U.S. Pat. No. 4,565,647 to Llenado and incorporated herein by reference, having a hydrophobic group containing from about 6 to about 30 carbon atoms, preferably from about 10 to about 16 carbon atoms and a polysaccharide, e.g., a polyglycoside, hydrophilic group. Further examples of suitable surfactants are described in McCutcheon's Vol. 1: Emulsifiers and Detergents, North American Ed., McCutcheon Division, MC Publishing Co., 1995, which is incorporated herein by reference.

Highly preferred materials of this class of nonionic surfactants are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Cationic Surfactants

The composition of the present invention can contain a cationic surfactant. When a cationic surfactant is added to the composition of the present invention, it can typically be added at a level from about 0.05% to about 30%, preferably from about 0.05% to about 20%, and more preferably from about 0. 1% to about 10% of the composition.

The cationic surfactant can optionally be one or more fabric softener actives. Preferred fabric softening actives according to the present invention include amines and quaternized amines. The following are examples of preferred softener actives: N,N-di(tallowyl-oxy-ethyl)-N,N-dimethyl ammonium chloride; N,N-di(canolyl-oxy-ethyl)-N,N-dimethyl ammonium chloride; N,N-di(tallowyl-oxy-ethyl)-N-methyl, N-(2-hydroxyethyl) ammonium methyl sulfate; N,N-di (canolyl-oxy-ethyl)-N-methyl, N-(2-hydroxyethyl) ammonium methyl sulfate; N,N-di(tallowylamidoethyl)-N-methyl, N-(2-hydroxyethyl) ammonium methyl sulfate; N,N-di(2-tallowyloxy-2-oxo-ethyl)-N,N-dimethyl ammonium chloride; N,N-di(2-canolyloxy-2-oxo-ethyl)-N,N-dimethyl ammonium chloride; N,N-di(2-tallowyloxyethylcarbonyloxyethyl)-N,N-dimethyl ammonium chloride; N,N-di(2-canolyloxyethylcarbonyloxyethyl)-N,N-dimethyl ammonium chloride; N-(2-tallowyloxy-2-ethyl)-N-(2-tallowyloxy-2-oxo-ethyl)-N,N-dimethyl ammonium chloride; N-(2-canolyloxy-2-ethyl)-N-(2-canolyloxy-2-oxo-ethyl)-N,N-dimethyl ammonium chloride, N,N,N-tri(tallowyl-oxy-ethyl)-N-methyl ammonium chloride; N,N,N-tri (canolyl-oxy-ethyl)-N-methyl ammonium chloride; N-(2-tallowyloxy-2-oxoethyl)-N-(tallowyl)-N,N-dimethyl ammonium chloride; N-(2-canolyloxy-2-oxoethyl)-N-(canolyl)-N,N-dimethyl ammonium chloride; 1,2-ditallowyloxy-3-N,N,N-trimethylammoniopropane chloride; and 1,2-dicanolyloxy-3-N,N,N-trimethylammo-niopropane chloride; and mixtures of the above actives. Particularly preferred is N,N-di(tallowyl-oxy-ethyl)-N,N-dimethyl ammonium chloride, where the tallow chains are at least partially unsaturated and N,N-di(canoloyl-oxy-ethyl)-N,N-dimethyl ammonium chloride, N,N-di(tallowyl-oxy-ethyl)-N-methyl, N-(2- hydroxyethyl) ammonium methyl sulfate; N,N-di (canolyl-oxy-ethyl)-N-methyl, N-(2- hydroxyethyl) ammonium methyl sulfate; and mixtures thereof. Additional fabric softening agents useful herein are described in U.S. Pat. No. 5,643,865 to Mermelstein et al., U.S. Pat. No. 5,622,925 to de Buzzaccarini et al., U.S. Pat. No. 5,545,350 to Baker et al., U.S. Pat. No. 5,474,690 to Wahl et al., U.S. Pat. No. 5,417,868 to Turner et al., U.S. Pat. No. 4,661,269 to Trinh et al., U.S. Pat. No. 4,439,335 to Burns , U.S. Pat. No. 4,401,578 to Verbruggen, U.S. Pat. No. 4,308,151 to Cambre, U.S. Pat. No. 4,237,016 to Rudkin et al., U.S. Pat. No. 4,233,164 to Davis, U.S. Pat. No. 4,045,361 to Watt et al., U.S. Pat. No. 3,974,076 to Wiersema et al., U.S. Pat. No. 3,886,075 to Beenadino, U.S. Pat. No. 3,861,870 Edwards et al., and European Patent Application publication No. 472,178, by Yamamura et al., all of said documents being incorporated herein by reference.

Other suitable cationic surfactants include ethoxylated quaternary ammonium surfactants. Some preferred ethoxylated quaternary ammonium surfactants include PEG-5 cocoammonium methosulfate; PEG-15 cocoammonium chloride; PEG-15 oleoammonium chloride; and bis(polyethoxyethanol) tallow ammonium chloride. Further examples of suitable surfactants are described in McCutcheon's Vol. 1: Emulsifiers and Detergents, North American Ed., McCutcheon Division, MC Publishing Co., 1995, which is incorporated herein by reference.

The counterion to these cationic surfactants may be selected, without limitation, from the group consisting of fluoride, chloride, bromide, iodide, chlorite, chlorate, hydroxide, hypophosphite, phosphite, phosphate, carbonate, formate, acetate, lactate, and other carboxylates, oxalate, methyl sulfate, ethyl sulfate, benzoate, and salicylate, and the like. Highly preferred materials of this class of cationic surfactants and their counterions are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Amphoteric and Zwitterionic Surfactants

The composition of the present invention can contain amphoteric and/or zwitterionic surfactants. When an amphoteric or zwitterionic surfactant is added to the composition of the present invention, it can typically be added at a level from about 0.05% to about 30%, preferably from about 0.05% to about 20%, and more preferably from about 0.1% to about 10% of the composition.

Suitable amphoteric surfactants include amine oxides having the formula $(R_1)(R_2)(R_3)NO$ wherein each of $R_1$, $R_2$ and $R_3$ is independently a saturated substituted or unsubstituted, linear or branched hydrocarbon chains of from 1 to 30 carbon atoms. Preferred amine oxide surfactants to be used according to the present invention include amine oxides having the formula $(R_1)(R_2)(R_3)NO$ wherein $R_1$ is an hydrocarbon chain comprising from 1 to 30 carbon atoms, preferably from 6 to 20, more preferably from 8 to 16, further preferably from 8 to 12, and wherein $R_2$ and $R_3$ are independently substituted or unsubstituted, linear or branched hydrocarbon chains comprising from 1 to 4 carbon atoms, preferably from 1 to 3 carbon atoms, and more preferably are methyl groups. $R_1$ may be a saturated substituted or unsubstituted, linear or branched hydrocarbon chain. Suitable amine oxides for use herein are, for instance, naturally derived hydrocarbon blends of $C_8$-$C_{10}$ amine oxides as well as $C_{12}$-$C_{16}$ amine oxides commercially available from Hoechst.

Suitable zwitterionic surfactants may contain both cationic and anionic hydrophilic groups on the same molecule at a relatively wide pH range. A typical cationic group is a quaternary ammonium group, although other positively charged groups like phosphonium, imidazolium and sulfonium groups can be used. Typical anionic hydrophilic groups are carboxylates and sulfonates, although other groups like sulfates, phosphonates, and the like can be used. A generic formula for some zwitterionic surfactants that can be used herein is $R_1$—$N'(R_2)(R_3)R_4X$— wherein $R_1$ is a hydrophobic group; $R_2$ and $R_3$ are each $C_1$-$C_4$ alkyl, hydroxy alkyl or other substituted alkyl group which can also be joined to form ring structures with the N; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is preferably a carboxylate or sulfonate group. Preferred hydrophobic groups $R_1$ are alkyl groups containing from 1 to 24, preferably less than 18, and more preferably less than 16 carbon atoms. The hydrophobic group can contain unsaturation and/or substituents and/or linking groups such as aryl groups, amido groups, ester groups and the like. In general, the simple alkyl groups are preferred for cost and stability reasons. Examples of amphoteric surfactants include alkylampho glycinates, and alkyl imino propionate. Highly preferred zwitterionic surfactants include betaine and sulphobetaine surfactants, derivatives thereof or mixtures thereof. The betaine or sulphobetaine surfactants are preferred herein as they are particularly suitable for the cleaning of delicate materials, including fine fabrics such as silk, wool and other naturally derived textile materials. Betaine and sulphobetaine surfactants are also extremely mild to the skin and/or fabrics to be treated that come in contact with the users skin.

Suitable betaine and sulphobetaine surfactants to be used herein include the betaine/sulphobetaine and betaine-like detergents wherein the molecule contains both basic and acidic groups which form an inner salt giving the molecule both cationic and anionic hydrophilic groups over a broad range of pH values. Some common examples of these detergents are described in U.S. Pat. No. 2,082,275 to Daimler et al., U.S. Pat. No. 2,702,279 to Funderburk et al., and U.S. Pat. No. 2,255,082 to Orthner et al., which are incorporated herein by reference. Further examples of suitable surfactants are described in McCutcheon's Vol. 1: Emulsifiers and Detergents, North American Ed., McCutcheon Division, MC Publishing Co., 1995, which is incorporated herein by reference.

Highly preferred materials of this class of amphoteric and zwitterionic surfactants are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Anionic Surfactants

The composition can contain an anionic surfactant. When an anionic surfactant is added to the composition of the present invention, it can typically be added at a level from about 0.05% to about 15%, preferably from about 0.05% to about 5%, and more preferably from about 0.1% to about 1% of the composition.

Suitable anionic surfactants include $C_8$-$C_{18}$ alkyl sulfonates, $C_{10}$-$C_{14}$ linear or branched alkyl benzene sulfonates, $C_{10}$-$C_{14}$ alkyl sulfates and ethoxysulfates (e.g., STEPANOL AMC from Stepan), and $C_9$-$C_{15}$ alkyl ethoxy carboxylates (NEODOX surfactants available from Shell Chemical Corporation). Suitable commercially available sulfonates are available from Stepan under the trade name BIO-TERGE PAS-88 as well as from the Witco Corporation under the trade name WITCONATE NAS-8(8), and Hostapur SAS(E) from Hoechst Aktiengesellschaft, D-6230 Frankfurt, Germany. Anionic surfactants may be paired with organic counterions or multivalent counterions in order to prevent interference with cationic species. Further examples of suitable surfactants are described in McCutcheon's Vol. 1: Emulsifiers and Detergents, North American Ed., McCutcheon Division, MC Publishing Co., 1995, which is incorporated herein by reference.

Highly preferred materials of this class of anionic surfactants are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Soil Release Agents

The composition can include a soil release agent which is present from about 0% to about 5%, preferably from about 0.05% to about 3%, and more preferably from about 0.1% to about 2% of the composition. Polymeric soil release agents useful in the present invention include copolymeric blocks of terephthalate and polyethylene oxide or polypropylene oxide, and the like. A preferred soil release agent is a copolymer having blocks of terephthalate and polyethylene oxide. More specifically, these polymers may be comprised of repeating units of ethylene terephthalate and polyethylene oxide terephthalate at a molar ratio of ethylene terephthalate units to polyethylene oxide terephthalate units from about 25:75 to about 35:65, and the polyethylene oxide terephthalate containing polyethylene oxide blocks having molecular weights from about 300 to about 2000. The molecular weight of this type of polymeric soil release agent can be in the range from about 5,000 to about 55,000. Suitable soil release agents are disclosed in U.S. Pat. No. 4,702,857 to Gosselink; U.S. Pat. No. 4,711,730 to Gosselink et al.; U.S. Pat. No. 4,713,194 to Gosselink; U.S. Pat. No. 4,877,896 to Maldonado et al.; U.S. Pat. No. 4,956,447 Gosselink et al.; and U.S. Pat. No. 4,749,596 to Po et al., all of which are incorporated herein by reference. Especially desirable optional ingredients are polymeric soil release agents comprising block copolymers of polyalkylene terephthalate and polyoxyethylene terephthalate, and block copolymers of polyalkylene terephthalate and polyethylene glycol. The polyalkylene terephthalate blocks may preferably comprise ethylene and/or propylene groups. Many such soil release polymers are nonionic, for example, the nonionic soil release polymer described in U.S. Pat. No. 4,849,257 to Borcher, Sr., et al., which is incorporated herein by reference. The polymeric soil release agents useful in the present invention can include anionic and cationic polymeric soil release agents. Suitable anionic polymeric or oligomeric soil release agents are disclosed in U.S. Pat. No.4,018,569 to Chang, which is incorporated herein by reference. Other suitable polymers are disclosed in U.S. Pat. No. 4,808,086 to Evans et al., which is incorporated herein by reference.

Highly preferred materials of this class of soil release polymers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Antistatic Agents

The composition can include antistatic agents, which can be present at a level from about 0% to about 5%, preferably from about 0.005% to about 5%, more preferably from about 0.05% to about 2%, and further preferably from about 0.2% to about 1% of the composition. Preferred antistatic agents of the present invention include cationic surfactants, including quaternary ammonium compounds such as alkyl benzyl dimethyl ammonium chloride; dicoco quaternary ammonium chloride; coco dimethyl benzyl ammonium chloride; soya trimethyl quaternary ammonium chloride; hydrogenated tallow dimethyl benzyl ammonium chloride; and methyl dihydrogenated tallow benzyl ammonium chloride. Other preferred antistatic agents of the present invention are alkyl imidazolinium salts. Other preferred antistatic agents are the ion pairs of, e.g., anionic detergent surfactants and fatty amines, or quaternary ammonium derivatives thereof, e.g., those disclosed in U.S. Pat. No. 4,756,850 to Nayar, which is incorporated herein by reference. Other preferred antistatic agents are ethoxylated and/or propoxylated sugar derivatives. Preferred antistatic agents include monolauryl trimethyl ammonium chloride, hydroxycetyl hydroxyethyl dimethyl ammonium chloride (available from Henkel Corporation under the trade name DEHYQUART E), and ethyl bis(polyethoxyethanol) alkyl ammonium ethyl sulfate (available from Witco Corporation under the trade name VARIQUAT 66), polyethylene glycols, polymeric quaternary ammonium salts (such as those available from Rhône-Poulenc Corporation under the MIRAPOL trade name), quaternized polyethyleneimines, vinylpyrrolidone/methacrylamidopropyl trimethylammonium chloride copolymer (available from GAF Corporation under the trade name GAFQUAT HS-100), triethonium hydrolyzed collagen ethosulfate (available from Maybrook Inc. under the trade name QUAT-PRO E), and mixtures thereof.

Highly preferred materials of this class of antistatic agents are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Fragrance

Perfumes or fragrance materials may be added to the composition. The selection of the perfume or perfumes may be based upon the application, the desired effect on the consumer, and preferences of the formulator. The perfume selected for use in the compositions and formulations of the present invention may contain ingredients with odor characteristics which are preferred in order to provide a fresh impression on the surface to which the composition is directed, for example, those which provide a fresh impression for fabrics. Such perfume may be preferably present at a level from about 0.01% to about 5%, preferably from about 0.05% to about 3%, and more preferably from about 0.1% to about 2% of the total composition.

Preferably, the perfume may be composed of fragrance materials selected from the group consisting of aromatic and aliphatic esters having molecular weights from about 130 to about 250; aliphatic and aromatic alcohols having molecular weights from about 90 to about 240; aliphatic ketones having molecular weights from about 150 to about 260; aromatic ketones having molecular weights from about 150 to about 270; aromatic and aliphatic lactones having molecular weights from about 130 to about 290; aliphatic aldehydes having molecular weights from about 140 to about 200; aromatic aldehydes having molecular weights from about 90 to about 230; aliphatic and aromatic ethers having molecular weights from about 150 to about 270; and condensation products of aldehydes and amines having molecular weights from about 180 to about 320; and mixtures thereof. Examples of such perfumes or fragrance materials include, but are not limited to: adoxal (2,6,10-trimethyl-9-undecen-1-al), allyl amyl glycolate, allyl cyclohexane (allyl-3-cyclohexylpropionate), amyl acetate (3-methyl-1-butanol), amyl salicylate, anisic aldehyde (4-methoxybenzaldehyde), aurantiol (condensation product of methyl anthranilate and hydroxycitronellal), bacdanol (2-ethyl-4-(2,2,3-trimethyl-3-cyclopenten-1-yl)-2-buten-1-ol), benzaldehyde, benzophenone, benzyl acetate, benzyl salicylate, damascone (1-(2,6,6-trimethyl-1-cyclohexen-1-yl)-2-buten-1-one, 3-hexen-1-ol, buccoxime (1,5-dimethyl-oximebicyclo [3,2,1]octan-8-one), cedrol (octahydro-3,6,8,8-tetramethyl-1H-3A,-7-methanoazulen-6-ol), cetalox (dodecahydro-3A,6,-6,9A-tetramethylnaphtho[2,1]furan), cis-3-hexenyl acetate, cis-3-hexenyl salicylate, citronellol (3,7-dimethyl-6-octenol), citronellyl nitrile (geranyl nitrile), clove stem oil, coumarin, cyclohexyl salicylate, cymal (2-methyl-3-(p-isopropylphenyl)-propionaldehyde), decyl aldehyde, damascone (1-(2,6,6-trimethyl-3-cyclohexen-1-yl)-2-buten-1-one), dihydromyrcenol (2,6-dimethyl-7-octan-2-ol), dimethyl benzyl carbinyl acetate, ethyl vanillin, ethyl-2-methyl butyrate, ethylene brassylate (ethylene tridecan-1,13-dioate), eucalyptol (1,8-epoxy-p-menthane), eugenol (4-allyl-2-methoxyphenol), exaltolide (cyclopentadecanolide), floor acetate (dihydronorcyclopentadienyl acetate), florhydral (3-(3-isopropylphenyl)butanal), frutene (dihydronorcyclopentadienyl propionate), galaxolide (1,3,4,6,7,8-hexahydro-4,6,6,7,8,8-hexamethylcyclopent-gamma-2-benzopyrane), gamma-decalactone (4-N-heptyl-4-hydroaldehyde), cinnamic aldehyde, hexyl salicylate, hydroxyambran (2-cyclododecylpropanol), hydroxycitronellal, ionone (4-(2,6,6-trimethyl-1-cyclohexenyl-1-yl)-3-buten-2-one), ionone (4-(2,6,6-trimethyl-1-cyclohexene-1-yl)-3-butene-2-one), ionone (4-(2,6,6-trimethyl-2-methylcyclohexyl-1-yl)-3-methyl-3-buten-2-one), 7-acetyl-1,2,3,4,5,6,7,8-octahydro-1,1,6,7-tetramethylnaphthalene, isoeugenol (2-methoxy-4-(1-propenyl)-phenol), isojasmone (2-methyl-3-(2-pentenyl)-2-cyclopenten-1-one), koavone (acetyl diisoamylene), lauric aldehyde, lavandin, lavender, natural lemon (major component d-limonene), d-limonene/orange terpenes (1-methyl-4-isopropenyl-1-cyclohexene), linalool (3-hydroxy-3,7-dimethyl-1,6-octadiene), linalyl acetate (3-hydroxy-3,7-dimethyl-1,6-octadiene acetate), Irg™ 201 (2,4-dihydroxy-3,6-dimethyl benzoic acid methyl ester), lyral (4-(4-hydroxy-4methyl-pentyl)-3-cyclohexene-1-carboxaldehyde), majantol (2,2-dimethyl-3-(3-methylphenyl)-propanol), mayol (4-(1-methylethyl)-cyclohexanemethanol), methyl anthranilate (methyl-2-aminobenzoate), methyl-alpha-naphthyl ketone, methyl cedrylone (methyl cedrenyl ketone), methyl chavicol (1-methyloxy-4,2-propen-1-yl benzene), methyl dihydrojasmonate, methyl nonyl acetaldehyde, musk indanone (4-acetyl-6-tert-butyl-1,1-dimethylindane), nerol (2-cis-3,7-dimethyl-2,6-octadien-1-ol), nonalactone (4-hydroxynonanoic acid lactone), norlimbanol (1-(2,2,6-trimethyl-cyclohexyl)-3-hexanol), orange CP (major component d-limonene), para-tert-bucinal (2-methyl-3-(p-tert-butylphenyl)-propionaldehyde), p-hydroxyphenylbutanone, patchouli, phenyl acetaldehyde (1-oxo-2-phenylethane), phenyl acetaldehyde, dimethyl acetal, phenyl ethyl acetate, p-menth-1-en-8-ol, p-menth-1-en-1-ol, terpinyl acetate p-menth-1-en-8-yl acetate), tetrahydrolinalool (3,7-dimethyl-3-octanol), tetrahydromyrcenol (2,6-dimethyl-2-octanol), tonalid/musk plus (7-acetyl-1,1,3,4,4,6-hexamethyltetralin), undecalactone (4-N-heptyl-4-hydroxybutanoic acid lactone), undecavertol (4-methyl-3-decen-5-ol), undecanal, undecylenic aldehyde, vanillin (4-hydroxy-3-methoxybenzaldehyde), verdox (2-tert-butyl cyclohexyl acetate), vertenex (4-tert-butyl cyclohexyl acetate), and mixtures thereof.

The selection of such perfumes and fragrance materials is well-known to those of skill in the art, both for desired scent and appropriate scent impact. For example, when high initial perfume odor impact on fabrics is desired, it can be preferable to select a perfume containing perfume ingredients which are not too hydrophobic. The degree of hydrophobicity of a perfilme ingredient can be correlated with its octanol/water partitioning coefficient P, the ratio between its equilibrium concentration in octanol and in water. Thus, a perfume ingredient with a greater partitioning coefficient P is more hydrophobic and a perfume ingredient with a smaller partitioning coefficient P is more hydrophilic; a selection based on the application and intended effect may be made accordingly. For example, in a fabric application, the preferred perfume ingredients may have an octanol/water partitioning coefficient P of about 1,000 or smaller.

Highly preferred materials of this class of fragrances and perfumes are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Antimicrobials and Preservatives

Optionally, antimicrobials or preservatives can be added to the present invention. Typical concentrations for biocidal effectiveness of these compounds may range from about 0.001% to about 0.8%, preferably from about 0.005% to about 0.3%, and more preferably from about 0.01% to 0.2% of the usage composition. The corresponding concentrations for the concentrated compositions are from about 0.003% to about 2%, preferably from about 0.006% to about 1.2%, and more preferably from about 0.1% to about 0.8% of the concentrated compositions.

Preservatives are especially preferred when organic compounds that are subject to microorganisms are added to the compositions of the present invention, especially when they are used in aqueous compositions. When such compounds are present, long term and even short-term storage stability of the compositions and formulations becomes an important issue since contamination by certain microorganisms with subsequent microbial growth often results in an unsightly and/or malodorous solution. Therefore, because microbial growth in these compositions and formulations is highly objectionable when it occurs, it is preferable to include a solubilized water-soluble, antimicrobial preservative, which is effective for inhibiting and/or regulating microbial growth in order to increase storage stability of the preferably clear and often aqueous compositions and formulations of the present invention.

Typical microorganisms that can be found in laundry products include bacteria, for example, *Bacillus thurigensis* (cereus group) and *Bacillus sphaericus*, and fungi, for example, *Aspergillus ustus*. *Bacillus sphaericus* is one of the most numerous members of *Bacillus* species in soils. In addition, microorganisms such as *Escherichia coli* and *Pseudoinonas aeruginosa* are found in some water sources, and can be introduced during the preparation of aqueous solutions of the present invention. It is preferable to use a broad spectrum preservative, for example, one that is effective on both bacteria (both gram positive and gram negative) and fungi. A limited spectrum preservative, for example, one that is only effective on a single group of microorganisms, for example, fungi, can be used in combination with a broad spectrum preservative or other limited spectrum preservatives with complimentary and/or supplementary activity. A mixture of broad spectrum preservatives can also be used. Antimicrobial preservatives useful in the present invention can be biocidal compounds, that is, substances that kill microorganisms, or biostatic compounds, that is, substances that inhibit and/or regulate the growth of microorganisms. Preferred antimicrobial preservatives include those that are water-soluble and are effective at low levels. In general, the water-soluble preservatives that may be used include organic sulfur compounds, halogenated compounds, cyclic organic nitrogen compounds, low molecular weight aldehydes, quaternary compounds, dehydroacetic acid, phenyl and phenoxy compounds, and mixtures thereof. Examples of preservatives useful in the present invention include, but are not limited to, the short chain alkyl esters of p-hydroxybenzoic acid (commonly known as parabens); N-(4-chlorophenyl)-N-(3,4-dichlorophenyl) urea (also known as 3,4,4-trichlorocarbanilide or triclocarban); 2,4,4-trichloro-2'-hydroxydiphenyl ether, commonly known as triclosan); a mixture of about 77% 5-chloro-2-methyl-4-isothiazolin-3-one and about 23% 2-methyl-4-isothiazolin-3-one, a broad spectrum preservative available from the Rohm and Haas Company as a 1.5% aqueous solution under the trade name KATHON CG; 5-bromo-5-nitro-1,3-dioxane, available from Henkel Corporation under the trade name BRONIDOX L; 2-bromo-2-nitropropane-1,3-diol, available from Inolex Chemical Company under the trade name BRONOPOL; 1,1-hexamethylenebis(5-p-(chlorophenyl)biguanide) (commonly known as chlorhexidine) and its salts, for example, with acetic and digluconic acids; a 95:5 mixture of 1,3-bis(hydroxymethyl)-5,5-dimethyl-2,4-imidazolidinedione and 3-butyl-2-iodopropynyl carbamate, available from Lonza Inc. under the trade name GLYDANT Plus; N-[1,3-bis (hydroxymethyl)2,5-dioxo-4-imidazolidinyl]-N,N'-bis(hydroxy-methyl) urea, commonly known as diazolidinyl urea, available from Sutton Laboratories, Inc. under the trade name GERMALL II; N,N"-methylenebis-[N'-[1-(hydroxymethyl)-2,5-dioxo-4-imidazolidinyl]urea] (commonly known as imidazolidinyl urea), available, for example, from 3V-Sigma under the trade name ABIOL, from Induchem under the trade name UNICIDE U-13, and from Sutton Laboratories, Inc. under the trade name GERMALL 115; polymethoxy bicyclic oxazolidine, available from Huls America Inc. under the trade name NUOSEPT; formaldehyde; glutaraldehyde; polyaminopropyl biguanide, available from ICI Americas, Inc. under the trade name COSMOCIL CQ or from Brooks Industries Inc. under the trade name MIKROKILL dehydroacetic acid; and mixtures thereof. In general, however, the preservative can be any organic preservative material which is appropriate for the application, for example, in a laundry application such preservative will preferably not cause damage to fabric appearance, for example, discoloration, coloration, or bleaching of the fabric. If the antimicrobial preservative is included in the compositions and formulations of the present invention, it is preferably present in an effective amount, wherein an "effective amount" means a level sufficient to prevent spoilage or prevent growth of inadvertently added microorganisms for a specific period of time. Preferred levels of preservative are from about 0.0001% to about 0.5%, more preferably from about 0.0002% to about 0.2%, further preferably from about 0.0003% to about 0.1%, of the composition. Optionally, the preservative can be used at a level which provides an antimicrobial effect on the treated fabrics.

The composition may suitably use an optional solubilized, water-soluble antimicrobial active, useful in providing protection against organisms that become attached to the treated material. The free, uncomplexed antimicrobial, e. g., antibacterial, active provides an optimum antibacterial performance. Sanitization of fabrics can be achieved by the compositions of the present invention containing, antimicrobial materials, e.g., antibacterial halogenated compounds, quaternary compounds, and phenolic compounds. Some of the more robust antimicrobial halogenated compounds which can function as disinfectants/sanitizers as well as finish product preservatives, and are useful in the compositions of the present invention include 1,1'-hexamethylene bis(5-(p-chlorophenyl)biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water. When chlorhexidine is used as a sanitizer in the present invention it can typically be present at a level from about 0.001% to about 1.0%, preferably from about 0.002% to about 0.3%, and more preferably from about 0.01% to about 0.1%, by weight of the usage composition. In some cases, a level from about 1% to about 2% may be needed for virucidal activity. Other useful biguanide compounds include COSMOCI, CQ, VANTOCIL IB, including poly (hexamethylene biguanide) hydrochloride. Other useful cationic antimicrobial agents include the bis-biguanide alkanes. Usable water soluble salts of the above are chlorides, bromides, sulfates, alkyl sulfonates such as methyl sulfonate and ethyl sulfonate, phenylsulfonates such as p-methylphenyl sulfonates, nitrates, acetates, gluconates, and the like. Non- limiting examples of useful quaternary compounds include: (1) benzalkonium chlorides and/or substituted benzalkonium chlorides such as commercially available BARQUAT (available from Lonza), MAQUAT (available from Mason), VARIQUAT (available from Witco/Sherex), and HYAMINE (available from Lonza); (2) dialkyl quaternary such as BARDAC products of Lonza, (3) N-(3-chloroallyl) hexaminium chlorides such as DOWICIDE and DOWTCIL available from Dow; (4) benzethonium chloride such as HYAMINE 1622 from Rohm & Haas; (5) methylbenzethonium chloride represented by HYAMINE 1OX supplied by Rohm & Haas, (6) cetylpyridinium chloride such as Cepacol chloride available from of Merrell Labs.

Preferred antimicrobial compounds for use herein include quaternary ammonium compounds containing alkyl or substituted alkyl groups, alkyl amide and carboxylic acid groups, ether groups, unsaturated alkyl groups, and cyclic quaternary ammonium compounds, which can be chlorides, dichlorides, bromides, methylsulphates, chlorophenates, cylcohexylsulphamates or salts of the other acids. Among the useful cyclic quaternary ammonium compounds are the following:—alkylpyridinium chlorides and/or sulphates, the alkyl group being preferably cetyl, dodecyl or hexadecyl group;—alkylisoquinolyl chlorides and/or bromides, the alkyl group being preferably dodecyl group. Particularly suitable quaternary ammonium compounds for use herein include alkyl dimethyl benzyl ammonium chloride, octyl decyl dimethyl ammonium chloride, dioctyl dimethyl ammonium chloride, didecyl dimethyl ammonium chloride, alkyl dimethyl ammonium saccharinate, cetylpyridinium and mixtures thereof.

Highly preferred materials of this class of antimicrobials and preservatives are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Dyes and Colorants

Optionally, dyes and colorants can be added to the present invention. Typical concentrations of these compounds may range from about 0.001% to about 0.8%, preferably from about 0.005% to about 0.3%, and more preferably from about 0.01% to 0.2% of the usage composition.

Colorants and dyes, especially bluing agents, can be optionally added to the compositions of the present invention for visual appeal and performance impression. When colorants are used, they may be used at extremely low levels to avoid fabric staining. Preferred colorants for use in the present compositions include highly water-soluble dyes, for example, LIQUITINT dyes available from Milliken Chemical Company. Non-limiting examples of suitable dyes are LIQUITINT Blue HP, LIQUITINT Blue 65, LIQUITINT Patent Blue, LIQUITINT Royal Blue, LIQUITINT Experimental Yellow 8949-43, LIQUITINT Green HMC, LIQUITINT Yellow II, and mixtures thereof. Any dye can be used in the compositions of the present invention, but nonionic dyes are preferred to decrease interaction with the zeta potential modifier and/or with the dye transfer inhibitor employed in combination with the inventive compositions. Useful acid dyes include: Polar Brilliant Blue and D&C Yellow #10, both supplied by Hilton Davis Chemical Company. Nonionic LIQUITINT dyes supplied by Milliken Chemical Company are also useful.

Suitable colors include, but are not limited to, Acid Black 1, Acid Blue 3, Acid Blue 9 Aluminum Lake, Acid Blue 74, Acid Green 1, Acid Orange 6, Acid Red 14 Aluminum Lake, Acid Red 27, Acid Red 27 Aluminum Lake, Acid Red 51, Acid Violet 9, Acid Yellow 3, Acid Yellow 3 Aluminum Lake, Acid Yellow 73, Aluminum Powder, Basic Blue 6, Basic Yellow 11, Carotene, Brilliant Black 1, Bromocresol Green, Chromium Oxide Greens, Curry Red, D&C Blue No. 1 Aluminum Lake, D&C Blue No. 4, D&C Brown No. 1, D&C Green No. 3 Aluminum Lake, D&C Green No. 5, D&C Orange No. 4 Aluminum Lake, D&C Red No. 6, D&C Red No. 6 Aluminum Lake, D&C Violet No. 2, D&C Yellow No. 7, D&C Yellow No. 11, D&C Blue No. 1, FD&C Yellow No. 5 Aluminum Lake, iron oxides, Pigment Orange 5, Pigment Red 83, Pigment Yellow 73, Solvent Orange 1, Solvent Yellow 18, ultramarines, and zinc stearate.

Highly preferred materials of this class of dyes and colorants are those that do not effectively bind to or permanently dye or color fabrics treated by use of the invention compositions, nor cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Viscosity Control Agents

Optionally added viscosity control agents can be organic or inorganic in nature and may either lower or raise the viscosity of the formulation. Examples of organic viscosity modifiers to lower viscosity are aryl carboxylates and sulfonates (for example including, but not limited to benzoate, 2-hydroxybenzoate, 2-aminobenzoate, benzenesulfonate, 2-hydroxybenzenesulfonate, 2-aminobenzenesulfonate), fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides and acetates of ammonium ion and the group IA and IIA metals of the Periodic Table of the Elements, for example, calcium chloride, lithium chloride sodium chloride, potassium chloride, magnesium chloride, ammonium chloride, sodium bromide, potassium bromide, calcium bromide, magnesium bromide, ammonium bromide, sodium iodide, potassium iodide, calcium iodide, magnesium iodide, ammonium iodide, sodium acetate, potassium acetate, or mixtures thereof. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desire of the formulator. Typical levels of salts used to control the composition viscosity are from 0 to about 10%, preferably from about 0.01% to about 6%, and more preferably from about 0.02% to about 3% of the composition.

Viscosity modifiers (raising) or thickening agents can be added to increase the ability of the compositions to stably suspend water-insoluble articles, for example, perfume microcapsules. Such materials include hydroxypropyl substituted guar gum (such as that available from Rhône-Poulenc Corporation under the trade name JAGUAR HP200), polyethylene glycol (such as that available from Union Carbide Corporation under the trade name CARBOWAX 20M), hydrophobic modified hydroxyethylcellulose (such as that available from the Aqualon Company under the trade name NATROSOL Plus), and/or organophilic clays (for example, hectorite and/or bentonite clays such as those available from the Rheox Company under the trade name BENTONE 27, 34 and 38 or from Southern Clay Products under the trade name BENTOLITE L; and those described in U.S. Pat. No. 4,103,047 to Zaki, et al., which is herein incorporated by reference). These viscosity raisers (thickeners) can typically be used at levels from about 0.5% to about 30%, preferably from about 1% to about 5%, more preferably from about 1.5% to about 3.5 %, and further preferably from about 2% to about 3%, of the composition.

Highly preferred materials of this class of thickeners and viscosity control and viscosity modifiers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Pearlizing and Opacifying Agents

Examples of pearlizing or opacifing agents that can optionally be added to the compositions of this invention include, but are not restricted to, glycol distearate, propylene glycol distearate, and glycol stearate. Some of these products are available from Witco Corporation under the KEMESTER trade name.

Highly preferred materials of this class of pearlizing and opacifying agents are those that do bind to treated fabrics, nor cause any significant color change nor impart any discoloration, such as whitening, graying or yellowing, to the fabrics to which they are applied, either during treatment followed by drying and/or curing, or after the drying and/or curing step followed by normal exposure to the elements, such as air, moisture or sunlight exposure.

Antioxidants and Sunscreen materials

Examples of antioxidants that can optionally be added to the compositions of this invention are propyl gallate, available from Eastman Chemical Products, Inc. under the trade names TENOX PG and TENOX S-1, and dibutylated hydroxytoluene, available from UOP Inc. under the trade name SUSTANE BHT. Also preferred are antioxidants for providing sun-fade protection for fabrics treated with the composition of the present invention, such antioxidants being described in EP0773982, and incorporated herein by reference. Preferred antioxidants include 2-(N-methyl-N-cocoamino)ethyl-3',5'-di-tert-butyl-4'-hydroxybenzoate; 2-(N,N-dimethyl-amino)ethyl-3',5'-di-tert-butyl-4'-hydroxybenzoate; 2-(N-methyl-N-cocoamino)ethyl-3',4',5'-trihydroxybenzoate; and mixtures thereof, more preferably 2-(N-methyl-N-cocoamino)ethyl-3',5'-di-tert-butyl-4'-hydroxy benzoate. Of these compounds, the butylated derivatives are preferred in the compositions of the present invention because tri-hydroxybenzoates have a tendency to discolor upon exposure to light. The antioxidant compounds of the present invention demonstrate light stability in the compositions of the present invention. "Light stable" means that the antioxidant compounds in the compositions of the present invention do not discolor when exposed to either sunlight or simulated sunlight for approximately 2 to 60 hours at a temperature of from about 25° C. to about 45° C. Antioxidant compounds and free radical scavengers can generally protect dyes from degradation by first preventing the generation of single oxygen and peroxy radicals, and thereafter terminating the degradation pathways. Not to be limited by theory, a general discussion of the mode of action for antioxidants and free radical scavengers is disclosed in Kirk Othmer, The Encyclopedia of Chemical Technology, Volume 3, pages 128-148, Third Edition (1978) which is incorporated herein by reference.

Compositions of the present invention may comprise an organic sunscreen. Suitable sunscreens can have UVA absorbing properties, UVB absorbing properties, or a combination of both. The compositions of the present invention may preferably comprise a UVA absorbing sunscreen actives that absorb UV radiation having a wavelength from about 320 nm to about 400 nm. Suitable UVA absorbing sunscreen actives include dibenzoylmethane derivatives, anthranilate derivatives such as methylanthranilate and homomethyl-1-N-acetylanthranilate, and mixtures thereof. Examples of dibenzoylmethane sunscreen actives are described in U.S. Pat. No 4,387,089 to De Polo; and in Sunscreens: Development, Evaluation, and Regulatory Aspects edited by N. J. Lowe and N. A. Shaath, Marcel Dekker, Inc (1990), which are incorporated herein by reference. The UVA absorbing sunscreen active is preferably present in an amount to provide broad-spectrum UVA protection either independently, or in combination with, other UV protective actives that may be present in the composition. Preferred UVA sunscreen actives include dibenzoylmethane sunscreen actives and their derivatives. They include, but are not limited to, those selected from 2-methyldibenzoylmethane, 4-methyldibenzoylmethane, 4-isopropyldibenzoylmethane, 4-tert-butyldibenzoylmethane, 2,4-dimethyldibenzoylmethane, 2,5-dimethyldibenzoylmethane, 4,4'-diisopropylbenzoylmethane,4-(1,1-dimethylethyl)-4'- methoxydibenzoylmethane, 2-methyl-5-isopropyl-4'-methoxydibenzoylmethane, 2-methyl-5-tert-butyl-4'-methoxydibenzoylmethane, 2,4-dimethyl-4'-methoxydibenzoylmethane, 2,6-dimethyl-4'-tert-butyl-4'-methoxydibenzoylmethane, and mixtures thereof. Preferred dibenzoyl sunscreen actives include those selected from 4-(1,1-dimethylethyl)-4'-methoxydibenzoylmethane, 4-isopropyldibenzoylmethane, and mixtures thereof. A more preferred sunscreen active is 4-(1,1-dimethylethyl)-4'-methoxydibenzoylmethane, which is also known as butylethoxydibenzoylmethane or Avobenzone, is commercially available under the names of PARSOL 1789 from Givaudan Roure (International) S. A. (Basel, Switzerland) and EUSOLEX 9020 from Merck & Co., Inc (Whitehouse Station, N.J.). The sunscreen 4-isopropyldibenzoylmethane, which is also known as isopropyldibenzoylmethane, is commercially available from Merck under the name of EUSOLEX 8020. The compositions of the present invention may preferably further comprise a UVB sunscreen active that absorbs UV radiation having a wavelength of from about 290 nm to about 320 nm. The compositions may preferably comprise an amount of the UVB sunscreen active that is safe and effective to provide UVB protection either independently, or in combination with, other UV protective actives that may be present in the compositions. The compositions preferably comprise from about 0.1% to about 16%, more preferably from about 0.1% to about 12%, and further preferably from about 0.5% to about 8% by weight, of UVB absorbing organic sunscreen. A wide variety of UVB sunscreen actives are suitable for use herein. Nonlimiting examples of such organic sunscreen actives are described in U.S. Pat. No. 5,087,372 to Toyomot and U.S. Pat. Nos. 5,073,371 and 5,073,372 both to Turner et al, which are incorporated herein by reference. Preferred UVB sunscreen actives are selected from 2-ethylhexyl-2-cyano-3,3-diphenylacrylate (referred to as octocrylene), 2-phenyl-benzimidazole-5-sulphonic acid (PBSA), cinnamates and their derivatives such as 2-ethylhexyl-p-methoxycinnamate and octyl-p-methoxycinnamate, TEA salicylate, octyldimethyl PABA, camphor derivatives and their derivatives, and mixtures thereof. Preferred organic sunscreen actives include 2-ethylhexyl-2-cyano-3,3-diphenylacrylate (commonly named octocrylene), 2-phenyl-benzimidazole-5-sulphonic acid (PBSA), octyl-p-methoxycinnamate, and mixtures thereof. Salt and acid neutralized forms of the acidic sunscreens are also useful.

An agent may also be added to any of the compositions useful in the present invention to stabilize the UVA sunscreen and to prevent it from photo-degrading on exposure to UW radiation and thereby maintaining its UVA protection efficacy. Wide ranges of compounds have been cited as providing these stabilizing properties and should be chosen to compliment both the UVA sunscreen and the composition as a whole. Suitable stabilizing agents include, but are not limited to, those described in U.S. Pat. No. 5,972,316 to Robinson; U.S. Pat. No. 5,968,485 to Robinson; U.S. Pat. No. 5,935,556 to Tanner et al.; and U.S. Pat. No. 5,827,508 Tanner et al. which are incorporated herein by reference. Preferred examples of stabilizing agents for use in the present invention include 2-ethylhexyl-2-cyano-3,3-diphenylacrylate (referred to as octocrylene), ethyl-2-cyano-3,3-diphenylacrylate, 2-ethylhexyl-3,3-diphenylacrylate, ethyl-3,3-bis (4-methoxyphenyl)acrylate, and mixtures thereof.

Highly preferred materials of this class of antioxidants and sunscreen actives are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

The composition of the present invention may preferably deposit from about 0.1 mg/g fabric to about 5 mg/g fabric of the sun-fade actives to reduce the sun fading of the fabric. Treatment of fabric with compositions of the present invention repeatedly, may result in higher deposition levels, which contributes even further to the sun-fading protection benefit.

Dye Transfer Inhibitors and Dye Fixatives

The composition can comprise from about 0.001% to about 20%, preferably from about 0.5% preferably to about 10%, and more preferably from about 1% to about 5% of one or more dye transfer inhibitors or dye fixing agents.

Compositions and formulations of the present invention can contain ethoxylated amines, amphoterics, betaines, polymers such as polyvinylpyrrolidone, and other ingredients that inhibit dye transfer. Optional dye fixing agents can be cationic, and based on quaternized nitrogen compounds or on nitrogen compounds having a strong cationic charge which is formed in situ under the conditions of usage. Cationic fixatives are available under various trade names from several suppliers. Representative examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneamine-based) ex Sandoz; SANDOFIX TPS, ex Sandoz, is a preferred dye fixative for use herein. Additional non-limiting examples include SANDOFIX SWE (a cationic resinous compound) from Sandoz, REWIN SRF, REWIN SRF-O and REWIN DWR Crochet-Beitlich GMBH; Tinofix ECO, Tinofix FRD and Solvent from Ciba-Geigy. Other cationic dye fixing agents are described in "After treatments for Improving the Fastness of Dyes on Textile Fibres", Christopher C. Cook, Rev. Prog. Coloration, Vol. XH, (1982). Dye fixing agents suitable for use in the present invention include ammonium compounds such as fatty acid-diamine condensates, inter alia, the hydrochloride, acetate, methosulphate and benzyl hydrochloride salts of diamine esters. Non-limiting examples include oleyldiethyl aminoethylamide, oleylmethyl diethylenediamine methosulphate, and monostearylethylene diaminotrimethylammonium methosulphate. In addition, the N-oxides of tertiary amines; derivatives of polymeric alkyldiamines, polyamine-cyanuric chloride condensates; and aminated glycerol dichlorohydrins are suitable for use as dye fixatives in the compositions of the present invention.

Highly preferred materials of this class of dye transfer inhibitors and dye fixatives are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Chlorine Scavengers

The compositions of the present invention may optionally comprise from about 0.01%, preferably from about 0.02%, more preferably from about 0.25% to about 15%, further preferably to about 10%, and yet more preferably to about 5% of a chlorine scavenger. In cases wherein the cation portion and the anion portion of the non-polymeric scavenger each react with chlorine, the amount of scavenger can be adjusted to fit the needs of the formulator. Suitable chlorine scavengers include ammonium salts having the formula: $[(R)_3R'N]X$ wherein each R is independently hydrogen, $C_1$-$C_4$ alkyl, —$C_1$-$C_4$ substituted alkyl, and mixtures thereof; preferably R is hydrogen or methyl, more preferably hydrogen; R' is hydrogen $C_1$-$C_{10}$ alkyl, $C_1$-$C_{10}$ substituted alkyl, and mixtures thereof. Preferably R is hydrogen and X is a compatible anion. Non-limiting examples include chloride, bromide, citrate, and sulfate; preferably X is chloride. Non-limiting examples of preferred chlorine scavengers include ammonium chloride, ammonium sulfate, and mixtures thereof, preferably ammonium chloride. Other chlorine scavengers include reducing agents such as thiosulfate.

Highly preferred materials of this class of chlorine scavengers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Wetting Agents

The present invention may contain as an optional ingredient from about 0.005% to about 3.0%, and more preferably from about 0.03% to 1.0% of a wetting agent. Such wetting agents may be selected from polyhydroxy compounds. Examples of water soluble polyhydroxy compounds that can be used as wetting agents in the present invention include glycerol, polyglycerols having a weight-average molecular weight from about 150 to about 800, and polyoxyethylene glycols and polyoxypropylene glycols having a weight-average molecular weight from about 200 to about 4000, preferably from about 200 to about 1000, and more preferably from about 200 to about 600. Polyoxyethylene glycols having a weight-average molecular weight from about 200 to about 600 are especially preferred. Mixtures of the above-described polyhydroxy compounds may also be used. A particularly preferred polyhydroxy compound is polyoxyethylene glycol having a weight-average molecular weight of about 400, available from Union Carbide Corporation under the trade name PEG-400.

Highly preferred materials of this class of wetting agents are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Electrolyte

Suitable inorganic salts for use as an optional electrolyte in the present compositions include $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3PO_4$, $NaSO_3$, $Na_2SO_4$, $Na_2SO_3$, $NaNO_3$, $Na_4P_2O_5$, sodium silicate, sodium metasilicate, sodium tetrachloroaluminate, sodium tripolyphosphate (STPP), $Na_2S_3O_7$, sodium zirconate, $CaF_2$, $CaCl_2$, $CaBr_2$, $CaI_2$, $CaSO_4$, $Ca(NO_3)_2$, KI, KBr, KCl, KF, $KNO_3$, $KIO_3$, $K_2SO_4$, $K_2SO_3$, $K_3PO_4$, $K_4(P_2O_7)$, potassium pyrosulfate, potassium pyrosulfite, LiI, LiBr, LiCl, LiF, $LiNO_3$, $AlF_3$, $AlCl_3$, $AlBr_3$, $AlI_3$, $Al_2(SO_4)_3$, $Al(PO_4)$, $Al(NO_3)_3$, aluminum silicate; including hydrates of these salts and including combinations of these salts or salts with mixed cations e.g. potassium aluminum $AlK(SO_4)_2$ and salts with mixed anions, e.g. potassium tetrachloroaluminate and sodium tetrafluoroaluminate. Salts incorporating cations from groups IIIa, IVa, Va, VIa, VIIa, VIII, Ib, and IIb on the periodic chart with atomic numbers >13 are also useful in reducing dilution viscosity but less preferred due to their tendency to change oxidation states and thus they can adversely affect the odor or color of the formulation or lower weight efficiency. Salts with cations from group Ia or IIa with atomic numbers >20 as well as salts with cations from the lanthanide or actinide series are useful in reducing dilution viscosity, but less preferred due to lower weight efficiency or toxicity. Mixtures of above salts are also useful.

Also preferred are quaternary ammonium salts, quaternary alkyl ammonium salts, quaternary dialkyl ammonium salts, quaternary trialkyl ammonium salts and quaternary tetraalkyl ammonium salts wherein the alkyl substituent comprises a methyl, ethyl, propyl, butyl or higher $C_5$-$C_{12}$ linear alkane radical, or combinations thereof. Organic salts useful in this invention include, magnesium, sodium, lithium, potassium, zinc, and aluminum salts of the carboxylic acids including formate, acetate, proprionate, pelargonate, citrate, gluconate, lactate, aromatic acids e.g. benzoates, phenolate and substituted benzoates or phenolates, such as phenolate, salicylate, polyaromatic acids terephthalates, and polyacids e.g. oxylate, adipate, succinate, benzenedicarboxylate, benzenetricarboxylate. Other useful organic salts include carbonate and/or hydrogen carbonate ($HCO_3^{-1}$) when the pH is suitable, alkyl and aromatic sulfates and sulfonates, e.g., sodium methyl sulfate, benzene sulfonates and derivatives such as xylene sulfonate, and amino acids when the pH is suitable.

Electrolytes can comprise mixed salts of the above, salts neutralized with mixed cations such as potassium/sodium tartrate, partially neutralized salts such as sodium hydrogen tartrate or potassium hydrogen phthalate, and salts comprising one cation with mixed anions.

Highly preferred materials of this class of inorganic and organic electrolytes are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Generally, inorganic electrolytes are preferred over organic electrolytes for better weight efficiency and lower costs. Mixtures of inorganic and organic salts can be used. Typical levels of electrolyte in the present compositions can be less than about 10%, preferably from about 0.5% to about 5%, more preferably from about 0.75% to about 2.5%, and further preferably from about 1% to about 2% of the inventive composition.

Enzymes

Additional desirable adjuncts may be enzymes (although it may be preferred to also include an enzyme stabilizer), including, but not limited to hydrolases, hydroxylases, cellulases, peroxidases, laccases, mannases, amylases, lipases and proteases. Proteases are one especially preferred class of enzymes. Typical examples of proteases include Maxatase and Maxacal from Genencor International, Alcalase, Savinase, and Esperase, all available from Novozymes North America, Inc. See also U.S. Pat. No. 4,511,490 to Stanislowski et al., incorporated herein by reference. Further suitable enzymes are amylases, which are carbohydrate-hydrolyzing enzymes. It may also be preferred to include mixtures of amylases and proteases. Suitable amylases include Termamyl from Novozymes, North America Inc, and Maxamyl from Genencor International Co. Still other suitable enzymes are cellulases, such as those described in U.S. Pat. No. 4,479,881 to Tai; U.S. Pat. No. 4,443,355 to Murata et al.; U.S. Pat. No. 4,435,307 to Barbesgaard et al.; and U.S. Pat. No. 3,983,082 to Ohya et al., incorporated herein by reference. Yet other suitable enzymes are lipases, such as those described in U.S. Pat. No. 3,950,277 to Silver; U.S. Pat. No. 4,707,291 to Thom et al.; U.S. Pat. Nos. 5,296,161 and 5,030,240 both to Wiersema et al.; and U.S. Pat. No. 5,108,457 to Poulose et al., incorporated herein by reference. The hydrolytic enzyme may be present in an amount of about 0. 01-5%, more preferably about 0.01-3%, and further preferably about 0.1-2% by weight of the detergent. Mixtures of any of the foregoing hydrolases are desirable, especially protease/amylase blends.

Highly preferred materials of this class of enzymes are those that do not cause any significant residual odor or color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Bleaching Agents

The compositions of the present invention may optionally comprise from about 0.01%, preferably from about 0.02%, more preferably from about 0.25% to about 15%, further preferably to about 10%, and yet more preferably to about 5% of a bleaching agent. Suitable bleaching agents include chlorine-releasing agents and peroxygen and peroxide-releasing compounds. Alkali metal hypochlorites, including sodium or potassium hypochlorite, are preferred chlorine releasing agents. Peroxygen compounds include alkali metal salts of percarbonate, perborate and peroxymonosulfate. Peroxide compounds, including hydrogen peroxide and compounds generating hydrogen peroxide in solution, peroxyacids and precursors to peroxyacids and peroxyimidic acids, and metal based oxidants are also suitable. Suitable bleaching agents include preformed peracids and organic peroxides, including alkonyl and acyl peroxides such as tertiary butyl peroxide and benzoyl peroxide, and related alkonyl and acyl peroxide and superoxide derivatives of alkyls and arenes. Additionally, an appropriate bleach activator for the active oxygen source or peroxide may be present, such those found in Arbogast et al., U.S. Pat. Nos. 5,739,327 and 5,741,437, Alvarez et al., U.S. Pat. No. 5,814,242, Deline et al., U.S. Pat. No. 5,877,315 and Casella et al., U.S. Pat. No. 5,888,419 (which relate to cyanonitrile derivatives), Fong et al., U.S. Pat. Nos. 4,959,187 and 4,778,816, Bolkan et al., U.S. Pat. Nos. 5,112,514 and 5,002,691, and Brodbeck et al., U.S. Pat. No. 5,269,962 (which relate to alkanoyloxyacetyl derivatives); and Mitchell et al., U.S. Pat. Nos. 5,234,616, 5,130,045 and 5,130,044 (all of which relate to alkanoyloxyphenylsulfonates), all of which are incorporated herein by reference.

Highly preferred materials of this class of bleaching agents are those that do not cause any significant fabric damage or color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Brighteners

Optical brighteners, also referred to as fluorescent whitening agents or FWA's, have long been used to impart whitening to fabrics during the laundering process. These fluorescent materials act by absorbing ultraviolet wavelength light and emitting visible light, generally in the color blue wavelength ranges. The FWA's settle out or deposit onto fabrics during the washing cycle. These include the stilbene, styrene, and naphthalene derivatives, which upon being impinged by ultraviolet light, emit or fluoresce light in the visible wavelength. These FWA's or brighteners are useful for improving the appearance of fabrics, which have become dingy through repeated soilings and washings. Preferred FWA's are Blankophor BBH, RKH and BHC, from Bayer Corporation; and Tinopal 5BMX-C, CBS-X and RBS, from Ciba-Geigy A. G.

Fluorescent whiteners most currently used in common laundry compositions generally fall into a category referred to in the art as diaminostilbene disulfonic acid-cyanuric chloride—or DASC—brighteners. These compounds have the general formula

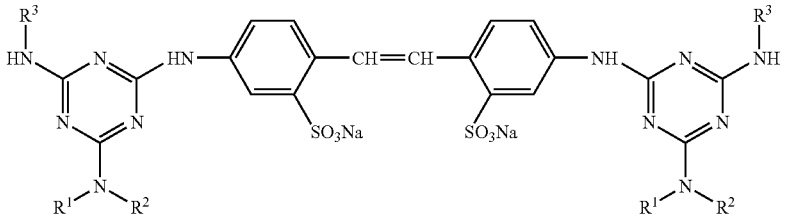

Examples of such DASC fluorescent whiteners include those sold by the Ciba-Geigy Corporation under the trade name "Tinopal", which are substituted stilbene 2,2'-disulfonic acid products, e.g., disodium 4,4'-bis-((4-anilino-6-morpholino-1,3,5-triazin-2-yl)amino)stilbene-2,2'-disulfonate (sold as Tinopal AMS); disodium 4,4'-bis-((4-anilino-6-(N-2-hydroxyethyl-N-methylamino)-1,3,5-triazin-2-yl)amino)stilbene-2,2'-disulfonate (sold as Tinopal 5BM); disodium 4,4'-bis-((4-anilino-6-(bis(2-hydroxyethyl)amino)-1,3,5-triazin-2-yl)amino)stilbene-2,2'-disulfonate (sold as Tinopal UNPA). Another example sold by Bayer Corporation is disodium 4,4'-bis-((4-anilino-6-methylamino)-1,3,5-triazin-2-yl)amino)stilbene-2,2'-disulfonate (sold as Phorwite HRS).

Examples of suitable FWA's can be found in U.K. Patent Nos. 1,298,577, 2,076,011, 2,026,054, 2,026,566, 1,393,042; and U.S. Pat. No. 3,951,960 to Heath et al., U.S. Pat. No. 4,298,290 to Barnes et al., U.S. Pat. No. 3,993,659 to Meyer, U.S. Pat. No. 3,980,713 to Matsunaga et al., and U.S. Pat. No. 3,627,758 to Weber et al., incorporated herein by reference. See also, U.S. Pat. No. 4,900,468 to Mitchell et al., column 5, line 66 to column 6, line 27, incorporated herein by reference.

Also preferred are cationic, nonionic, and amphoteric FWA's, such as those cited in U.S. Pat. Nos. 4,433,975, 4,432,886, 4,384,121, all to Meyer and U.S. Pat. No. 4,263,431 to Weber et al., and incorporated herein by reference. Further examples of suitable FWAs are described in McCutcheon's Vol. 2: Functional Materials, North American Ed., McCutcheon Division, MC Publishing Co., 1995, and Encyclopedia of Chemical Technology, $11^{th}$ volume, John Wiley & Sons, 1994, both of which are incorporated herein by reference. Other examples of fluorescent brightening materials suitable for the invention may be found in U.S. Pat. No. 6,251,303 to Bawendi et al.; U.S. Pat. No. 6,127,549 to Hao et al.; U.S. Pat. No. 6,133,215 to Zelger et al.; U.S. Pat. No. 6,117,189 to Reinehr et al.; U.S. Pat. No. 6,120,704 to Martini; and U.S. Pat. No. 6,162,869 to Sharma et al., incorporated herein by reference, Highly preferred materials of this class of brighteners are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

In selecting the various components for the fabric treatment composition, most preferred are those that do not cause any significant damage to treated fabrics or cause any significant color change, nor impart any discoloration, such as whitening, graying or yellowing, to the fabrics to which they are applied, either during treatment followed by curing and/or drying, or after the curing and/or drying step followed by normal exposure to the elements, such as air, moisture or sunlight exposure. In particular, dye and colorants should not undergo any significant change from their original color and not stain or discolor the fabrics to which they are applied. Finally, bleaching agents should also not interfere with the function of stain release and/or fabric treatment.

Formulation

The compositions of the present invention and/or products incorporating the compositions may be in any form known to those skilled in the art. For example, the compositions and/or products may be in the form of an aerosol, liquid, granular, powder, tablet, solid, paste, foam and/or bar compositional form, or their encapsulated or coated forms. These compositions and/or products may be neat or releasably absorbed or adsorbed on to a substrate, such as a woven or non-woven filament substrate or packaged within a suitable article of manufacture for convenient handling and dispensing.

In this aspect of the invention, an article of manufacture may be provided that comprises the inventive composition and a spray dispensing device, an aerosol dispensing device, a standard bottle, a device to release the composition into the rinse water, or a water soluble or water-insoluble sachet or package, or a water soluble or water-insoluble tablet or powder which enables release of the composition. A suitable film coating or encapsulate may also be employed with either a liquid or solid form to provide for release of the composition.

The spray dispenser can be any of the manually activated means for producing a spray of liquid droplets as is known in the art, e.g., trigger-type, pump-type, electrostatic spray device, non-aerosol self-pressurized, and aerosol-type spray devices. Regardless of the specific spray means employed, it is preferred that at least about 70%, more preferably, at least about 80%, and further preferably at least about 90% of the droplets have a particle size smaller than about 200 microns. Generally in instances where the potential for inhalation by users may occur, it is most preferred that at least about 70%, more preferably, at least about 80%, and further preferably at least about 90% of the droplets have a particle size larger than about 5 microns.

Suitable trigger-type and pump-type spray devices are disclosed in U.S. Pat. No. 4,161,288 to McKinney; U.S. Pat. No. 4,558,821 to Tada et al.; U.S. Pat. No. 4,434,917 to Saito et al; and U.S. Pat. No. 4,819,835 to Tasaki, all of said patents being incorporated herein by reference. Particularly preferred to be used herein are spray-type dispensers, such as T 8500 commercially available from Continental Spray International, or other manufactures commonly known in the trade. In such a dispenser, the liquid composition can be divided in fine liquid droplets resulting in a spray that is directed onto the fabric surface to be treated. Suitably fine droplet sizes are achieved in such spray-type dispensers owing to the mechanism of operation in which the composition contained in the body of the dispenser is directed through the spray-type dispenser bead via energy communicated to a pumping mechanism by the user as the composition is forced against an obstacle, such as a screen grid or a cone or the like, which provides sufficient shock to the stream of the ejected liquid composition to atomize the liquid composition and provide the formation of liquid droplets of sufficiently small size.

Preferably, the aerosol-dispensing device of the present invention can be any of the manually activated devices employing a pressurized propellant as known in the art. The aerosol dispenser may comprise a container which can be constructed of any of the conventional materials employed in fabricating aerosol containers. The dispenser should be capable of withstanding internal pressure in the range of about 20 to about 120 psig, and preferably from about 20 to about 80 psig. An important characteristic concerning the dispenser is that it be provided with a valve member which can permit the composition of the present invention to be dispensed in the form of a spray of very fine, or finely divided, particles or droplets. The aerosol dispenser utilizes a pressurized sealed container from which the composition of the present invention can be dispensed through a special actuator/valve assembly under pressure. The aerosol dispenser is pressurized by incorporating therein a gaseous component generally known as a propellant. Common aerosol propellants, e.g., gaseous hydrocarbons such as isobutane, mixed halogenated hydrocarbons, compressed air, nitrogen, inert gases, and carbon dioxide, are suitable. Highly preferred are those propellants that do not present environmental concerns, such as compressed air, nitrogen, inert gases and carbon dioxide. A more complete description of commercially available aerosol-spray dispensers appears in U.S. Pat. No. 3,436,772, to Stebbins and U.S. Pat. No. 3,600,325 to Kaufinan et al., which are incorporated herein by reference.

The spray dispenser can be a self-pressurized non-aerosol container having a convoluted liner and an elastomeric sleeve. The self-pressurized dispenser can be comprised of an assembly containing a liner and a sleeve comprising a thin, flexible radially expandable convoluted plastic liner of about 0.010 (0.25 mm) to about 0.020 (0.50 mm) inch thick, inside an essentially cylindrical elastomeric sleeve. The liner and sleeve assembly can be capable of holding a substantial quantity of the composition of the present invention and of causing the product to be dispensed. A description of such self-pressurized spray dispensers can be found in U.S. Pat. No. 5,111,971 to Winer and U.S. Pat. No. 5,232,126 to Winer which are incorporated herein by reference. Another suitable type of aerosol spray dispenser is one in which a barrier membrane separates the composition of the present invention from the propellant, as is disclosed in U.S. Pat. No. 4,260,110 to Werding which is incorporated herein by reference. Such a dispenser is available from EP Spray Systems, East Hanover, N.J.

Compositions of the present invention can be introduced into an automatic washing machine prior to or during the main wash cycle of the machine in any suitable form as described herein. Some commercial washing machines provide a presoaking cycle into which compositions of the present invention can be introduced. The presoaking or soaking cycle generally provides for treatment of clothing prior to introduction of a detergent or other additives prior to the main wash cycle. The compositions of the present invention may be employed alone as a sole treatment and may be employed in combination with other laundry additive products, such as liquid or powdered detergents, laundry additives or laundry booster products that are commonly in use. Additionally, the compositions of the present invention can be introduced subsequent to a detergent using a delayed release packaging material or device or similar means. Some commercial washing machines, for example, provide a means to automatically dispense an additive to the main wash water (the "wash liquor") after a short delay following the initiation of a wash cycle. Other "drop in" dosing and dispensing devices known to the art can also be employed for releasing the inventive compositions into the main wash cycle. Delayed release packaging can also be employed to hold and subsequently release the compositions of the present invention at a predetermined time during the wash cycle. When such delayed release packaging material is employed, it is desirable for the release of the inventive compositions to delayed in such a manner that sufficient time remains within the cycle time of the wash for the composition of the present invention to act upon the clothing in order to provide effective treatment thereupon. All of these approaches provide a means to treat articles, for example textiles, clothing, garments and the like, according to the methods of the present invention. Also suitable are methods in which articles are treated with the compositions and methods of the present invention in an aqueous liquor, such as washing by hand, washing in a tub, bucket or sink, as is commonly done with single articles, so-called delicates and fine items of clothing and textiles that are not typically machined washed.

It is also envisioned that the compositions can be formulated so as to assume the primary role of detergent in addition to imparting stain and soil resistance. Such compositions are especially preferred, in that in practice the consumer needs to purchase and use only a single all-in-one product, which imparts cleaning, stain and soil resistance. In such a case, the composition used according to the methods of the present invention would preferably be formulated to include optional adjuncts, such as surfactants, builders, fluorescent whitening agents, enzymes, and the like in appropriate levels to achieve the desired cleaning effect without having any effective impact on the hydrophobic agent, the zeta potential modifier or the optional fluoropolymer of the present invention in regards to the inventive method for imparting stain and soil resistance to the desired materials. Considerations enumerated above, especially careful adjustment of zeta potential modifier so that the wash liquor exhibits zeta potential greater than zero, result in compositions that are effective in cleaning, as well as in imparting stain and soil resistance as achieved by the methods of the present invention.

Compositions of the present invention can be introduced into an automatic washing machine during the rinse cycle of the machine using rinse water additive dispensers that are well known in the art. Examples include U.S. Pat. No. 5,768,918 to McKibben; U.S. Pat. No. 5,267,671 to Baginski et al.; U.S. Pat. No. 4,835,804 to Arnau-Munoz et al; U.S. Pat. No. 3,888,391 to Merz; and U.S. Pat. No. 3,108,722 to Torongo, Jr., et al. Centrifugal force applied to a weight inside the dispenser during a spin cycle of an automatic clothes washer can cause a dispenser valve to become unseated so that additive from the dispenser may spill out of the dispenser and mix with rinse water that is added to the washer after the spin cycle. The dispenser can be normally inserted into the washer before the wash cycle begins. It should remain closed during the agitation of the wash cycle, yet reliably open during the first spin cycle at the conclusion of the wash cycle in order to deliver the composition of the present invention at a point in time at which it will be most effective.

Compositions of the present invention may be packaged in sachet form for convenient dosing and handling by the user. The sachet may be of any suitable shape and construction. Highly convenient shapes from the viewpoints of both manufacture and packing are square and rectangular, but any other desired shape is also suitable. Preferred sachets may contain one, two, or more compartments. In a two-compartment sachet, the compartments may, for example, be side-by-side, joined by a common seal, or back-to-back, joined by a common wall. The former arrangement is more suitable if the two compartments are to be very different in size, and is also easier to make. Other multi-compartment arrangements are disclosed in EP 236136A which is incorporated herein by reference. The relative sizes of a single or multi-compartment sachet can be tailored to match the proportions of the total contents to be accommodated in each, and the optimum shape of the sachet chosen accordingly. For example, a single compartment or first compartment of a two-compartment sachet can contain a relatively larger dosage of the composition of the current invention for first treatment purposes, while the second compartment of a two-compartment sachet can contain a relatively smaller dosage for second or subsequent treatments, e.g., maintenance treatment purposes. The individual compartments of a two or multi-compartment sachet can be easily separated from one another by the user for dosage control when the contents comprise the same composition, enabling one, two or multiple compartments of the sachet to be used simultaneously, depending on the quantity of composition required. The second compartment of a two-compartment sachet may also contain ingredients other than the inventive composition such as typical adjuncts, e.g., other non-interfering ingredients being packed together with the composition of the current invention to provide a secondary benefit. The total amount of the composition of the current invention to be packaged in the sachet product may vary, for example, from 10 to 150 g for a half dose (20 to 300 g for a single dose), depending on the type and size of washing machine in which it is intended to be used, and the amount of fabric that is intended to be treated. It is generally preferred that the sachet system be designed such that the contents will be released at or very shortly after the time of addition to the wash liquor or the rinse water (the "rinse liquor"), depending upon which cycle of the wash the sachet containing the composition is added.

In an alternate embodiment, substantially complete delivery of the contents is delayed to occur after at most 30 minutes, and more preferably at most 25 minutes from the time of addition to the wash liquor so that the contents of the sachet, which is introduced during the wash cycle of the washing machine, are not substantially released until at least the beginning of the rinse cycle of the washing machine. In this latter embodiment, it may be sometimes be desirable for the sachet systems to be designed such that at least one compartment or sachet thereof gives a delayed or controlled release of the contents. Suitable sachet structures are described in EP236136A, Anderson, et al. which is incorporated herein by reference.

In another embodiment, a water-insoluble sachet may be employed to hold the fabric treatment composition. Such a water-insoluble sachet in accordance with this embodiment for delivery of the composition may be of the closed, water-permeable type that relies on leaching out by the wash liquor for release of its contents. Alternatively, the sachet may be provided with a seal that will open under washing machine conditions, by the action of water or of mechanical agitation or both; for example, as disclosed in EP312277A, Newbold, et al which is incorporated herein by reference. Opening sachets may be of either water-permeable or water-impermeable material, with water-permeable material being preferred. Suitable materials include paper, woven and non-woven fabrics, films of natural or synthetic ongin, or combinations thereof having a base weight between 1 and 100 g/m$^2$. Examples of these are disclosed, for example, in EP246897A, Newbold, et al., which is incorporated herein by reference, and include polyamide, polyester, polyacrylate, cellulose acetate, polyethylene, polyvinyl chloride, polypropylene, cellulosic fibers, regenerated cellulosic fibers, and mixtures thereof. Preferred materials include cellulose/polyester mix fabrics, and Manila/viscose non-woven paper. It is especially preferred that the seals are composed of a water-labile component and a heat-sealable component, as described in the before referenced EP246897A. These seals are sensitive at wash temperatures to the combination of water and mechanical agitation encountered in the washing machine environment, and open to release the sachet contents. It is preferable for the sachet substrate itself to be one that dissolves or disintegrates in the wash or rinse liquor. Especially preferred are sachets of water-soluble film. Such film materials are well-known in the art and include polyvinyl alcohols and partially hydrolyzed polyvinyl acetates, alginates, cellulose ethers such as carboxymethylcellulose and methyl cellulose, polyacrylates, polyethylene oxide, and combinations of these.

Also within the scope of the present invention are essentially dry means of delivery of the compositions, including granular, powder and tablet forms of delivery, which may comprise the present composition and a suitable inert carrier in which the composition is reversibly compounded such that the composition can be effectively released to the water when the granular, powder or tablet delivery means is brought into contact with water, e.g., introduced into the wash water. In general, granular compositions in accordance with the present invention can be made via a variety of methods including dry mixing, spray drying, agglomeration and granulation. Tablets suitable for delivery of the composition of the invention are well known in the art. Preferred are tablets of a size that are convenient for dosing in a washing machine. A preferred size is from 5 g to 200 g, more preferably from 5 g to 100 g, and the size can be selected in accordance with the intended wash load and the design of the washing machine which is to be used. Also suitable are tablets containing two or more compositional zones, in which one zone may comprise materials of the present invention and a second zone may comprises a carrier comprising, but not limited to, adjunct materials described herein as suitable optional additives.

Methodology

As further described herein, fabric treatment compositions of the present invention (with at least one zeta potential modifier) can be deposited onto fabrics by a number of methods. Regardless of the technique employed, the critical feature is that the hydrophobic agent, and any fluorocompound employed, become deposited on the fabric surface. Subsequent heating above ambient temperatures but below 100° C. reversibly cures the materials onto the fabric. However, excessive heating above 100° C. is to be avoided as the coating is then bound too tenaciously, leading to decreased overall performance. Without being bound by theory, it is believed that the coating should be reversibly bound to effect release of stains and soils in the subsequent wash.

One particularly preferred technique for consumers is to use the composition during laundering of soiled garments in conventional washing machines that have between a 25 to 90 liter capacity when filled. The machines typically have a fill/wash cycle of about 12 to 18 minutes duration (the initial volume of water is added), a rinse cycle of about 2 to 5 minutes duration (sufficient water added to disperse the soil and detergent and other laundry additives, and a spin cycle of about 10 to 20 minutes duration. Between the wash, rinse and spin cycles the introduced water is drained. These selected cycles are to be distinguished from the overall wash cycle itself, which encompasses all these sequential cycles or steps in the complete wash process provided by a conventional automatic washing machine.

When detergent is used, the inventive fabric treatment composition preferably includes at least one zeta potential modifier. In one variation, a composition containing the fluoropolymer, hydrophobic agent, and zeta potential modifier is added anytime during the wash, e.g., along with the detergent at the washing cycle. Alternatively, a composition containing the fluoropolymer and hydrophobic agent, but not a zeta potential modifier, is added with the detergent at the wash stage and thereafter, the zeta potential modifier, which is present in commercial fabric softener which contains cationic surfactant, becomes incorporated when the fabric softener is added to the washing machine during the rinse cycle.

When a commercial product is formulated so as to provide the role of detergent in addition to the method of imparting stain and soil resistance according to the method of the current invention, i.e., such that the formulated product contains additional optional adjuncts such as surfactants, builders, fluorescent whitening agents, enzymes and the like, have minimal impact on the active ingredients that impart stain and soil resistance, the inventive compositions can be added during the initial fill/wash cycle of a washing machine in which the cleaning and protective methods of the current invention may be practiced. This method is especially preferred, as the consumer does not need to further intervene in the automated laundry process.

An effective amount of the composition of the present invention can be sprayed or applied directly onto fabrics, particularly clothing. When the composition is sprayed or applied directly onto fabric, an effective amount can be deposited onto the fabric without causing saturation of the fabric, typically from about 10% to about 85%, preferably from about 15% to about 65%, and more preferably from about 20% to about 50%, by weight of the fabric. The amount of active that can be typically sprayed or applied directly onto the fabric is from about 0.1% to about 4%, preferably from about 0.2% to about 3%, and more preferably from about 0.3% to about 2% of the fabric. The treated fabric can then be tumble-dried in a standard clothes dryer and/or be ironed at the normal ironing temperature to effect curing. Alternatively, the treated fabric can be allowed to dry at ambient temperature, and the curing effected by a later heating step supplied by tumble-drying in a standard clothes dryer and/or ironed at the normal ironing temperature to effect curing. Alternatively, the treated fabric can be subjected to radiant energy, such as from the sun or infrared generating heat source, or to microwave energy, such as from a microwave dryer or microwave generating device, to effect curing of the applied composition. The treated fabric may simultaneously be dried and heated in one step to effect curing of the composition on the fabric, or these operations optionally conducted in separate steps, providing that the heating step is performed subsequent to the drying step if conducted separately.

Similarly, an effective amount of the composition can be aerosolized and applied onto fabrics, particularly clothing, by means of a clothes revitalizing device, such as the Whirlpool PERSONAL VALET system distributed by the Whirlpool Corporation, located at 2000 N. M-63, Benton Harbor, Mich. 49022-2692. When used in such a revitalizing device, the present composition can be combined with the revitalizing solution normally employed in the device, being combined in any desired ratio by volume, or substituted entirely in place of the revitalizing solution in order to effect treatment by use of composition of the present invention. An effective amount of the composition can be automatically metered and aerosolized to effect its deposition onto the clothes contained within the revitalizing device. A drying step subsequently performed by the revitalizing device equipped with an air blower and source of heat, or a source of heated air automatically follows the deposition step in order to complete treatment of the fabrics treated therein by the composition.

An effective amount of the present composition can also be soaked with fabric and then optionally washed before tumble drying, ironing or tumble-drying with optional ironing. In this aspect of the invention, an acceptable method of delivery is to add the composition to a separate soak or treatment cycle performed in a washing machine or other suitable container with or without agitation, such as hand-soaking of fabrics performed in a sink, bucket or other such container, in which the composition of the present invention is added to water present with sufficient agitation to uniformly mix the composition with the water to insure effective dispersal or dissolution of the composition to create a uniform dispersion or solution for subsequent treatment of the fabrics. The order of mixing can be in any order, that is, the composition can be added to water to effect dilution or water can be added to the composition to effect dilution after the composition is first introduced into a washing machine or other suitable container. In this aspect of the invention, it is preferable that the composition is first mixed with water to effect dilution in either scenario described above before fabrics are exposed to the diluted composition in order to effect the most uniform treatment possible. Subsequent agitation of the diluted composition and the fabrics is not generally required, although if preformed in a washing machine such agitation is generally provided during the wash cycle. Some newer washing machines, however, provide for a timed soaking cycle with no agitation or with intermittent agitation. Following such treatments, fabrics can be drained of excess fluid and then dried at a temperature less than 100° C. or optionally ironed at appropriate heat settings. An available option is to rinse with fresh water and/or wash the soaked fabrics, followed by tumble-drying at less than 100° C. or optionally ironing at appropriate heat settings.

In a further aspect of the invention, an effective amount of the composition can be added to the standard wash cycle of an automatic washing machine and/or tumble-dried with optional ironing. It is also a further option to add the invention to the standard wash cycle and optionally rinse the fabrics prior to drying at less than 100° C. with optional ironing. In these aspects of the invention, the composition may be combined with any laundry additive, a detergent, completely substitute the detergent, or additional surfactant and builders added to replace the detergent. In still another aspect of the invention, an effective amount of the composition can be added to the standard rinse or separate part of the rinse cycle and/or tumble-dried with optional ironing. In this aspect of the invention, the composition may be combined with fabric softener or other rinse additive. When added to the wash or rinse cycle, a variety of addition devices may also be used.

Many washing machines contain additive dispensers for laundry additives such as bleach or fabric softener. Other devices are known in the art to add liquids to the wash cycle and/or to release them into the rinse cycle. In addition, water soluble pouches, nonwoven pouches, powders and tablets may be used.

Another embodiment of this invention is to treat a nonwoven and/or woven carrier article with the inventive composition. A further embodiment of this method is to add a fragrance to the carrier article. The carrier article is maintained in a moist state until added to the dryer with articles to be treated. It is preferred that the carrier article remains moist to facilitate the transfer of the composition to the treated garments. This method is especially effective on delicate articles including, but not limited to, silk, wool, linen where excessive heat may cause unwanted effects. Furthermore, this method allows for the economical treatment of limited article loads or those containing articles that should not be immersed or exposed to large volumes of liquid.

When the present composition is added to the water present in a washing machine or water present in some other suitable container for soaking or hand-washing of fabrics, an effective amount can be present to effect deposition of the composition onto the fabric. The effective amount for a first treatment operation performed on a previously untreated fabric is typically from about 0.01% to about 10%, preferably from about 0.1% to about 5%, and more preferably from about 0.1% to about 2% of the composition to weight of the fabric present, wherein the ratio of the weight of dry fabric to the weight of water can be within a value between a ratio of 1:100 and 1:1, respectively, of the ratio of the dry fabric weight to water weight present.

Irrespective of the method of application employed to effect treatment of articles, a curing step is employed to complete treatment according to the methods of the present invention. Suitable curing step includes drying the articles treated with compositions according to the present invention at a temperature above ambient, but less than about 100° C. Also suitable is heated drying, that is heating the article above ambient temperatures, by such means including, but not limited to ironing, steaming, blow drying, drying under a heat lamp, drying near a radiative source of heat, or machine drying in a dryer of the treated articles following treatment with compositions of the present invention. Curing may also be effected by drying, following by a heating step wherein the treated dried articles are subsequently heated above ambient temperature for a time sufficient to effect treatment according to the methods of the present invention.

Following the first use of the composition of the present invention to treat a fabric, subsequent treatment of the fabric may be repeated in similar fashion by any or all means described above using amounts of the composition at the preferred first treatment level, or more preferably at a lower level, or maintenance level, sufficient to replenish material on the fabric that may be lost due to wear or subsequent washing after the first treatment. In general, the level of the present composition required to effectively treat a fabric in order to obtain desirable benefits are greater for the first treatment using previously untreated fabrics than for fabrics that have previously been treated using the present composition. Thus, subsequent, repeated treatments may generally require significantly lower amounts of the composition to effectively replenish material present on the fabric and to maintain the desirable benefits obtained with the first treatment performed. Subsequent, or maintenance, levels of the composition to be used to maintain the desired benefits exhibited by previously treated fabric is typically from about 0.001% to about 5%, preferably from about 0.01% to about 2%, and more preferably from about 0.01% to about 1%, by weight of the composition to weight of the water present, wherein the ratio of the weight of dry fabric to the weight of water is preferably within a value between a ratio of 1:100 and 1:1, respectively, of the ratio of the dry fabric weight to water weight present.

In still a further aspect of the invention, an effective amount of the composition can be added to a standard tumble-dryer with optional ironing. The composition may be used alone in any dryer delivery device, such as a nonwoven or sponge, or combined with fabric softener sheets, home dry cleaning devices, or other dryer device. Thus, another product form is a composition of the present invention (for example, a paste) suitable for coating onto, and delivery from, a substrate e.g. a flexible sheet or sponge or a suitable dispenser (such as a container having apertures therein, for example) during a tumble dryer cycle. A method of use is to add or release the present composition into the rinse water. When using an aqueous, solid, powder, foam, gel, pouch, tablet or sheet composition for treating fabric in the rinse step, an effective amount of active of the inventive composition can optionally contain fabric softener actives, perfume, electrolytes, chlorine scavenging agents, dye transfer inhibiting agents, dye fixative agents, phase stabilizers, chemical stabilizers including antioxidants, silicones, antimicrobial actives and/or preservatives, chelating agents, aminocarboxylate chelating agents, colorants, enzymes, brighteners, soil release agents, or mixtures thereof.

In still a further aspect of the invention, textiles treated with the compositions of the present invention, particularly delicate fabrics, fabrics composed of natural fibers including, but not limited to fur, wool or silks, fabrics comprising inclusions, panels, or mixed woven or non-woven compositions of heat sensitive natural or synthetic fibers including, but not limited to elastomeric materials such as rubber, SPANDEX, polyacetate, vinyl and nylon, may be so treated with the compositions of the present invention by any of the means described herein and allowed to dry under ambient conditions without the application of heat in order to prevent shrinking, dimensional distortion, wrinkling, creasing or other such deleterious effects that may be the result of applying heat to the wet textiles or heating the wet textiles sufficiently and for sufficient time to reduce them to an essentially dry state. Advantageously, such fabrics treated by the compositions of the present invention and allowed to dry under ambient conditions, may subsequently be exposed to a heat source to effect curing of the composition in order to obtain the full benefits of the treatment. Such dry fabrics subsequently exposed to a heat source including, but not limited to heating in an automatic dryer, or contact with steam, an iron, heated air from a blow dryer or other heat source, will not suffer from the deleterious effects noted herein that are commonly seen when such delicate fabrics are dried by heating to dryness starting from a substantially wet state. In this aspect of the invention, the time of exposure to a heat source required by textiles treated by the composition of the present invention and allowed to dry under ambient conditions, may be substantially reduced compared to the time of exposure to a heat source required if such textiles treated by the composition are brought to dryness directly from a wet state. Such reduced time of exposure to a heat source is beneficial to reduce such deleterious effects noted above for many textiles, particularly those labeled as delicate or dry-clean only textiles.

Drying is a function of both temperature and time. Effective drying can be achieved either by exposing treated garments to effectively higher drying temperatures for a shorter time, or exposing treated garments to effectively longer drying times with correspondingly lower drying temperatures. Preferred temperature and drying times are typically provided by selected cycles of commercially available automatic dryers under normal, permanent press and delicate cycle selections. Highly preferred are cycle selections that provide a short cooling down period with continued tumbling to provide for reduced wrinkling of tumbled fabrics, although this is not a requirement for treatment of fabrics treated by the compositions of the present invention, Drying the fabric at a temperature above 45° C. is preferred.

The compositions and articles of the present invention which contain a fabric improving active can be used to treat fabrics, garments, and the like to provide at least one of the following fabric care benefits: wrinkle removal and/or reduction, fabric wear reduction, fabric pilling reduction, fabric color fading reduction, fabric soiling reduction, fabric shape retention, and/or fabric shrinkage reduction.

The inventive composition can be applied by any of the above methods. In one method of use, a first composition can be first applied at a high effective amount of the requisite actives to give untreated fabrics the beneficial properties. Subsequent treatment of the same fabrics can be applied at a lower maintenance effective amount employing a second composition having requisite actives at a lower level, and therefore more economical usage benefit, but still effective at maintaining the beneficial protective properties provided to the treated fabrics in a first treatment step augmented by treatment in the second treatment step. In another embodiment, a kit consisting of the two treatment compositions as in the preceding embodiment may be employed, a first treatment composition with a first effective level of a hydrophobic agent, a fluoropolymer, and a zeta potential modifier, and optionally one or more additives; and a second treatment composition employed for subsequent and/or repeated treatment(s) to maintain the fabric protective properties provided in the first treatment step, where the second treatment composition has a second effective level of a hydrophobic agent, optionally a fluoropolymer, a zeta potential modifier, and optionally one or more additives. In one embodiment, a kit having a first treatment composition and a second treatment composition is employed, the kit having a first protective fabric treatment consisting of an aqueous composition having about (a) 5 to 10 weight % hydrophobic agent; (b) 5 to 30 weight % of a fluoropolymer; (c) 0.1 to 5 weight % zeta potential modifier; (d) optionally, 0.01 to 10 weight % bleaching agent; (e) optionally, 0.1 to 10 weight % surfactant; and (f) optionally, an additive; the kit also providing a second protective fabric treatment consisting of a second aqueous composition having about (g) 0.1 to 2.5 weight % hydrophobic agent; (h) 0.1 to 5 weight % zeta potential modifier; (i) optionally, 0.01 to 10 weight % bleaching agent; (j) optionally, 0.1 to 10 weight % surfactant; and (k) optionally, an additive. In one embodiment, the kit is employed in a first operation to first treat a fabric article, and then in a second operation to restore a fabric protective benefit provided by first use of the first fabric protective treatment. In another embodiment, the kit is employed in a first operation to first treat, and then in a second operation to maintain the first fabric protective treatment benefit by a second and/or subsequent series of second treatment steps employing the second treatment composition of the kit. In yet another embodiment, the second and/or subsequent series of second treatment operations may provide an enhanced or different second fabric benefit differing from the first fabric protective benefit provided in a first treatment operation. In a particular embodiment, for example, a first treatment composition has a hydrophobic agent, a fluoropolymer, zeta potential modifier and a compatible bleaching agent and surfactant to effect deep cleaning and stain removal of residue on a soiled fabric article during a first treatment operation, which provides a first fabric protective benefit having stain and soil release characteristics of reduced soiling; and in a second operation employing a second treatment composition, providing cleaning and maintenance of the protective benefit provided by the first treatment composition.

In another embodiment, the kit includes instructions for use of the first and second compositions for treating fabrics according to the inventive methods described herein to deliver and maintain the desired fabric protective properties, including wrinkle removal and/or reduction, fabric wear reduction, fabric pilling reduction, fabric color fading reduction, fabric soiling reduction, fabric shape retention, and/or fabric shrinkage reduction.

In other embodiments, concentrated compositions can be employed, and used as is or further diluted prior to use. Concentrated compositions comprise a higher level of fabric active, typically from about 1% to about 99%, preferably from about 2% to about 65%, and more preferably from about 3% to about 25%, by weight of the concentrated fabric care composition. Concentrated compositions are used in order to provide a less expensive product. The concentrated product can be used undiluted or diluted by about 1,000,000%, more preferably by about 25,000%, and even more preferably by about 5000% of the composition, by addition by weight of water.

The compositions of the present invention can also be used as ironing aids. An effective amount of the composition can be sprayed onto fabric and the fabric can be ironed at the normal ironing temperature recommended by the fabric label instruction guide. The fabric can be sprayed with an effective amount of the composition, allowed to dry and then ironed, or sprayed and ironed immediately to effect curing.

In a still further aspect of the invention, the present composition can be sprayed and/or misted onto fabrics and/or entire garments in need of de-wrinkling and/or other fabric care benefits in a manner such that excessive amounts of the fabric/garment care composition are prevented from being released to the open environment, provided in association with instructions for use to ensure that the consumer applies at least an effective amount of fabric improving active and/or fabric care composition, to provide the desired garment care benefit. Any spraying mechanism and/or misting mechanism can be used to apply the fabric care composition to fabrics and/or garments. One distribution of the garment care composition can be achieved by using a fog form. The mean particulate diameter size of the fabric care composition fog can be from about 5 microns to about 200 microns, preferably from about 5 microns to about 100 microns, and more preferably from about 10 microns to about 50 microns. The wash or rinse water should contain typically from 0.01 to 1 g of fluoropolymer per liter of wash water and from 0.01 to 1 g of hydrophobic agent per liter of wash water. The especially preferred levels of the inventive composition are from 0.01 to 0.5 g of fluoropolymer per liter of wash water and from 0.01 to 0.5 g of hydrophobic agent per liter of wash water. After treatment with an initial level of the composition, a maintenance level of present composition may be sufficient to maintain the properties. Desirable maintenance levels of the inventive composition can be from 0.01 to 0.2 g of fluoropolymer per liter of wash water and from 0.01 to 0.2 g of hydrophobic agent per liter of wash water. Especially preferred levels of the inventive composition might be from 0.01 to 0.1 g of fluoropolymer per liter of wash water and from 0.01 to 0.1 g of hydrophobic agent per liter of wash water.

The present invention also relates to a method of using an aqueous or solid, preferably powder or granular, composition to treat the fabrics in the wash cycle, with such compositions comprising the fabric protecting actives, and optionally, surfactants, builders, perfume, chlorine scavenging agents, dye transfer inhibiting agents, dye fixative agents, dispersants, detergent enzymes, heavy metal chelating agents, suds suppressors, fabric softener actives, chemical stabilizers including antioxidants, silicones, antimicrobial actives and/or preservatives, soil suspending agents, soil release agents, optical brighteners, colorants, and the like, or mixtures thereof. Depending on the selection of optional ingredients, such as the level and type of surfactants, the present composition can be used as a wash additive composition (when the surfactant level is low) or as a laundry detergent, which also has additional fabric care benefits. It is preferable that the treatment be performed in accordance with the instructions for use, to ensure that the consumer knows what benefits can be achieved, and how best to obtain these benefits.

The present invention also relates to a method for treating fabric in the drying step, comprising an effective amount of the fabric protecting actives of the present invention and, optionally, fabric softener actives, distributing agent, perfume, fiber lubricants, fabric shape retention polymers, lithium salts, potassium salts, phase stabilizers, chlorine scavenging agents, dye transfer inhibiting agents, dye fixative agents, chemical stabilizers including antioxidants, silicones, antimicrobial actives and/or preservatives, heavy metal chelating agents, aminocarboxylate chelating agents, enzymes, brighteners, soil release agents, and mixtures thereof. The present composition can take a variety of physical forms including liquid, foams, gel and solid forms such as solid particulate forms. One method comprises the treatment of fabric with a dryer-added fabric care composition in combination with a dispensing means such as a flexible substrate which effectively releases the fabric care composition in an automatic tumble clothes dryer. Such dispensing means can be designed for single usage or for multiple uses. Preferably, the composition is applied onto a sheet substrate to form a dryer sheet product.

Another method comprises the treatment of fabrics with a fabric protection composition of the invention dispensed from a sprayer at the beginning of and/or during the drying cycle. It is preferable that the treatment be performed in accordance with the instructions for use, to ensure that the consumer knows what benefits can be achieved, and how best to obtain these benefits.

The present invention also relates to a fabric care method of dipping and/or soaking fabrics before the fabrics are laundered, with a pre-wash fabric care composition of the invention containing an effective amount of fabric protecting active and, optionally, surfactants, builders, perfume, chlorine scavenging agents, dye transfer inhibiting agents, dye fixative agents, dispersants, detergent enzymes, heavy metal chelating agents, fabric softener actives, chemical stabilizers including antioxidants, silicones, antimicrobial actives and/or preservatives, soil suspending agents, soil release agents, optical brighteners, colorants, and the like, or mixtures thereof. It is preferable that the treatment be performed in accordance with the instructions for use, to ensure that the consumer knows what benefits can be achieved, and how best to obtain these benefits.

EXAMPLES

Experiments were conducted to demonstrate the superior effects of the fabric treatment composition and various application techniques that can be employed to effectively deliver the treatment composition. The data as presented in Tables 1-14 were based on compositions that did not include addition of a zeta potential modifier.

Subsequent data in these examples were based on compositions with at least one zeta potential modifier. As is apparent, compositions with at least one zeta potential modifier were also very effective in imparting the beneficial protective properties to the fabrics treated.

The examples in Table 1 illustrate compositions of the invention for addition to the laundry. The concentrations are based on the addition of 200 g of the inventive compositions to 2.72 kg of fabric in 69 liters of water in the wash or rinse cycle. Appropriate levels in compositions can be determined for other addition amounts, other levels of fabric, or other wash or rinse volume levels. Examples are given in weight percent as is, i.e., weight percent of the materials as commercially supplied as components in the final composition to achieve 100% by weight.

TABLE 1

| | Example | | | | | | | | | |
|---|---|---|---|---|---|---|---|---|---|---|
| | 1 | 2 | 3 | 4 | 5 | 6 | 7 | 8 | 9 | 10 |
| ZONYL 6700[a] | 34 | 5 | 63 | 27 | 4 | 50 | 20 | 3 | 37 | 15 |
| NALAN GN[b] | 34 | 63 | 5 | 27 | 50 | 4 | 20 | 37 | 3 | 15 |
| Balance water and minors[c] | q.s. | q.s. | q.s. | q.s. | q.s. | q.s. | q.s. | q.s. | q.s. | q.s. |

[a]Cationic fluoropolymer emulsion from DuPont Chemicals (20 weight % active)

[b]Cationic paraffin wax emulsion from DuPont Chemicals (15 weight % active, melting point less than 75° C.)

[c]Minors include surfactants, fragrance, fragrance extenders, preservatives, preservatives, antistatic agents, dyes and colorants, viscosity control agents, antioxidants, antifoaming agents, emulsifiers, brighteners, opacifiers, freeze-thaw control agents, shrinkage control agents, and mixtures thereof. (q.s. denotes "quantity sufficient" to achieve 100% by weight of the finished composition in each example noted.)

For fabrics that already exhibit some oil or water repellency, such as those treated with the above compositions, or polyester, polyester/cotton, or other fabrics that are more hydrophobic than cotton, a reduced level of the inventivecompositions can be used. The examples in Table 2 illustrate maintenance compositions of the invention for addition to the laundry. The concentrations are based on the addition 200 g of the inventive compositions to 2.72 kg of fabric in 69 liters of water in the wash or rinse cycle.

TABLE 2

| | Example | | | | | | | | | |
|---|---|---|---|---|---|---|---|---|---|---|
| | 11 | 12 | 13 | 14 | 15 | 16 | 17 | 18 | 19 | 20 |
| ZONYL 6700 | 7 | 3 | 11 | 5 | 1 | 9 | 4 | 1 | 7 | .5 |
| NALAN GN | 7 | 11 | 3 | 5 | 9 | 1 | 4 | 7 | 1 | .5 |
| Balance water and minors | q.s. | q.s. | q.s. | q.s. | q.s. | q.s. | q.s. | q.s. | q.s. | q.s. |

The examples in Table 3 illustrate compositions of the invention with additional actives. The concentrations are based on the addition of 200 g of the compositions to 2.72 kg of fabric in 69 liters of water in the wash or rinse cycle, or applying by one of the other suggested methods, such as spray application, presoak, or treatment in the dryer.

TABLE 3

| | Example | | | | | | | | | |
|---|---|---|---|---|---|---|---|---|---|---|
| | 21 | 22 | 23 | 24 | 25 | 26 | 27 | 28 | 29 | 30 |
| ZONYL 6700 | 10 | 10 | 10 | 10 | 10 | 10 | 3 | 5 | 5 | 20 |
| Nalan GN | 30 | 30 | 30 | 30 | 30 | 30 | 37 | 10 | 10 | 5 |
| SURFONIC L12-2.6[d] | 5 | | | | | | | | | |
| TRITON N101[e] | | 10 | | | | | | | | |
| Amphoterge K2[f] | | | 5 | | | | | | | |
| ADOGEN 442[g] | | | | 10 | | | | | | |
| AMMONYX LO[h] | | | | | 2 | | | | | |
| Magnesium chloride | | | | | | 2 | | | | |
| Sodium Thiosulfate | | | | | | | 0.6 | | | |
| Dibutylated hydroxytoluene[i] | | | | | | | | 0.1 | | |
| Balance water and minors | q.s. | q.s. | q.s. | q.s. | q.s. | q.s. | q.s. | q.s. | q.s. | q.s. |

[d]Alcohol ethoxylate, nonionic surfactant from Huntsman.

[e]Alcohol ethoxylate, nonionic surfactant from Union Carbide

[f]Imidazoline amphoteric surfactant from Lonza

[g]Dimethyl dehydrogenated tallow ammonium chloride, cationic surfactant from Goldschmidt Chemical.

[h]Dimethyl amine oxide from Huntsman from Lonza.

[i]Antioxidant from UOP Inc.

The examples in Table 4 illustrate compositions of the invention with alternative fluoropolymers and hydrophobic agents.

TABLE 4

| | 31 | 32 | 33 | 34 | 35 | 36 |
|---|---|---|---|---|---|---|
| ZONYL 6700[j] | 0.5 | | | | | 1.0 |
| ZONYL 8300[k] | | 0.2 | | | 0.2 | |
| ZONYL NWG[l] | | | 1.5 | 2.0 | | |
| MICHEM EMULSION 723[m] | | 1.0 | | | | |
| MICHEM EMULSION 743[n] | | | 0.5 | 0.2 | | |
| FREEPEL 1225[o] | | | | | 2.0 | |
| Balance water and minors | q.s. | q.s. | q.s. | q.s. | q.s. | q.s. |

[j]Cationic fluoropolymer emulsion from DuPont Chemicals (20 weight % active)
[k]Fluoropolymer emulsion from DuPont Chemicals
[l]Fluoropolymer emulsion from DuPont Chemicals
[m]Non-cationic microcrystalline wax emulsion from Michelman
[n]Non-cationic microcrystalline wax emulsion from Michelman
[o]Cationic microcrystalline wax emulsion from Noveon Contact Angle Measurements Contact angle measurements to determine the contact angle of both water and oil on a fabric or textile surface are performed using a goniometer. A goniometer manufactured by Ramé Hart, Inc was used having an illuminated specimen stage assembly and clamping system allowing a test fabric swatch to be positioned horizontally and clamped with sufficient tension to flatten the swatch to prevent sagging but without causing any substantial stretching or deformation of the swatch. The goniometer has an integral eye piece having both horizontal axis line indicator and an adjustable rotating cross line indicator and angle scale, both independently adjustable by separate veniers. It is important that gloves are worn when handling all samples, tools and fabric test swatches and that all glassware, tools, including rules and cutting implements, and syringes used are carefully cleaned with alcohol, such as isopropyl alcohol, and allowed to dry completely before use. Prior to contact angle measurement, test fabric swatch of approximate dimensions of 2.5 cm by 2.5 cm is clamped into place and the vertical venier adjusted to align the horizontal line (axis) of the eye piece coincident to the horizontal plane of the fabric swatch, and the horizontal position of the stage relative to the eye piece positioned so as to view one side of the test fluid droplet interface region at the swatch surface. Test fabric swatches are preferably cut from larger test fabrics at a variety of randomly selected areas of the test fabric to provide multiple samples for testing.

To determine the contact angle of the test fluid on the fabric swatch, approximately one drop of test fluid in an amount between about 0.010 and about 0.012 grams, is dispensed onto the swatch using a small syringe fitted with a stainless steel needle and a micrometer drive screw to displace a calibrated amount of the test fluid. For water measurements, purified water, for example deionized or distilled water, is employed, and for oil measurements, a vegetable oil, for example soybean oil (available from Bunge North America, St. Louis, Mo.) is suitably employed. Immediately upon dispensing the test fluid, the rotatable venier is adjustment to align the cross line and cross position, that is the intersection of the rotatable cross line and the fixed horizontal line, coincident with the edge of the test fluid droplet and the swatch, and the cross line angle (rotation) then positioned coincident with the tangent to the edge of the test droplet surface, as imaged by the eye piece. The contact angle is then read from the angle scale, which is equivalent to the tangent angle. The initial contact angle is that angle determined immediately after dispensing the test fluid to the swatch surface, which is taken to be essentially equivalent to time zero (t=0), and subsequent contact angles are then determined at approximately 30 second intervals thereafter to measure either the advancing or receding contact angle of the droplet with respect to the swatch surface, that is either the increasing or decreasing contact angle, respectively.

Initial contact angles above 30 degrees are indicators of effective water or oil repellancy. Also suitable are contact angles above 30 degrees that persist over relatively significant contact times, for example around 30 seconds to about 2 minutes. Higher initial contact angles of about 30 degrees and greater and persistent contact angles of about 30 degrees and greater are good indicators of effective water or oil repellency. Cotton weave swatches (also referred to as "flags") were treated with different concentrations of ZONYL 6700 for 12 min in 1500 grams of water at 25° C. in the Terg-O-Tometer, then squeezed and dried in the dryer for 40 min at 150° F. (65.5° C.). The 5% treatment of fluoropolymer solution is 5% as is based on the weight of cotton fabric in the treatment. This corresponds to a rinse cycle concentration of 1.23 grams per liter of rinse water. The contact angle was measured by putting a drop of water on the flags and measuring after 30 sec and 2 min. The results shown in Table 5 indicate that the fluoropolymer, used by itself even at high levels, is not effective at either water or oil repellency.

TABLE 5

| Composition | Contact Angle (water/oil) | |
|---|---|---|
| (weight %) | 30 sec | 2 min |
| 0% ZONYL 6700 | 0/0 | 0/0 |
| 1% ZONYL 6700 | 0/0 | 0/0 |
| 2.5% ZONYL 6700 | 0/0 | 0/0 |
| 5% ZONYL 6700 | 0/0 | 0/0 |

Cotton weave swatches were then washed with different concentrations of NALAN GN, an emulsified paraffin wax. The swatches were treated for 12 min. at 25° C. in a Terg-O-Tometer, then squeezed to remove excess solution and dried in the dryer for 40 min. at 150° F. (65.5° C.). The 5% treatment of hydrophobic agent solution is 5% as is based on the weight of cotton fabric in the treatment. This corresponds to a rinse cycle concentration of 1.23 grams per liter of rinse water. The contact angle was measured by putting a drop of water on the flags and measuring after 30 sec and 2 min. The results are shown in Table 6 and indicate that the wax emulsion, by itself even at high concentrations, is not effective at oil repellency.

TABLE 6

| Composition (weight %) | Contact angle (water/oil) 30 sec | 2 min |
|---|---|---|
| 0% NALAN GN | 0/0 | 0/0 |
| 1.0% NALAN GN | 0/0 | 0/0 |
| 2.5% NALAN GN | 75/0 | 55/0 |
| 5% NALAN GN | 100/0 | 76/0 |

Cotton weave swatches were treated at a low 1.0 weight % concentration of ZONYL 6991 with different concentrations of magnesium chloride for 12 min at 25° C. in a Terg-O-Tometer, then squeezed to remove excess solution and dried in the dryer for 40 min at 150° F. (65.5° C.). The 1.0 weight % treatment of ZONYL 6991 is 1.0 weight % as is based on the weight of cotton fabric in the treatment. This corresponds to a rinse cycle concentration of 0.25 grams per liter of rinse water. The contact angle was measured by putting a drop of water on the flags and measuring after 30 sec and 2 min. The results shown in Table 7 indicate that the fluoropolymer with high electrolyte concentration exhibits increased water repellency versus ZONYL 6991 used alone for treatment.

TABLE 7

| Composition (weight %) | Contact angle (water) 60 sec |
|---|---|
| 1% ZONYL 6991[a] 0% $MgCl_2$ | 0 |
| 1% ZONYL 6991 5% $MgCl_2$ | 50 |
| 1% ZONYL 6991 20% $MgCl_2$ | 100 |

[a]Cationic fluoropolymer emulsion from DuPont Chemicals

Cotton weave swatches were treated with different ratios of ZONYL 6700 and NALAN GN for 12 min at 25° C. in a Terg-O-Tometer, then squeezed to remove excess solution, rinsed and dried in the dryer for 40 min at 150° F. (65.5° C.). The contact angles with both water and oil droplets were measured after 30 seconds. The results shown in Table 8 indicate that approximately a 4:1 to 1:4 ratio of fluoropolymer to hydrophobic agent is desirable for both optimum oil and water repellency.

TABLE 8

| | 37 | 38 | 39 | 40 | 41 | 42 |
|---|---|---|---|---|---|---|
| ZONYL 6700 | 0.5% | 2% | 2.5% | 3% | 3.75% | 4.5% |
| NALAN GN | 4.5% | 3% | 2.5% | 2% | 1.25% | 0.5% |
| Contact Angle (water) 30 seconds | 117 | 110 | 112 | 110 | 121 | 52 |
| Contact Angle (oil) 30 seconds | 35 | 103 | 111 | 100 | 112 | 0 |

The examples in Table 9 show that using the inventive composition in the rinse is surprisingly superior to pretreatment with surface finishing treatments employing fluoropolymers that are commercially available for consumer usage. The pretreatment product locks in stains already on the fabric, while the inventive composition, in contrast, does not hinder removal of existing stains, but surprisingly, further acts to improve stain removal. A variety of stains were applied to untreated fabrics and allowed to age for at least 7 days to mimic the typical consumer delay before washing soiled laundry. The garments were then treated per label instructions using either a commercial consumer surface finishing treatment (SCOTCHGARD) or rinsed in a 5% loading of ZONYL 6991 (Inventive treatment). In both cases, fabric treatment was performed at solution temperatures of 25° C. for 12 minutes, followed by squeezing to remove excess solution and fabrics were then dried in a dryer for 40 minutes at 150° F. (65.5° C.). The stained/treated garments were then washed and rinsed in a commercially available residential washer using a label recommended level of LIQUID TIDE detergent (produced by the Procter & Gamble Company) and dried in a dryer for 40 minutes. Stain removal was judged visually using a 5 point scale where comparing treated and not-treated stained and washed garments where numeric scores were assigned based on the following descriptive scale: 1-Much worse than untreated, 2-Worse than untreated, 3-Equal to untreated, 4-Better than untreated, 5-Much better than untreated.

TABLE 9

| Stain Type (a) | Untreated | Inventive Treatment | SCOTCHGARD |
|---|---|---|---|
| Grass | Basis | 4 | 1 |
| Coffee | Basis | 4 | 1 |
| Clay | Basis | 3 | 2 |
| Salad Dressing | Basis | 3 | 3 |

a. Stain types include water-based stains (grass, coffee), oil-based stains (salad dressing) and particulate-based stains (clay).

An experiment was conducted to compare the breathability of fabrics treated with commercially available anti-stain treatments with that of the invention. The porosity of the fabric to liquid water was used as a judge of breathability. The porosity was determined by the ability of the fabric to support a measured weight of a column of water. SCOTCHGARD Protector (3M Company) was used as a representative of commercially available anti-stain treatments, and the SCOTCHGARD treatment was used per the label instructions. 100% cotton weave fabrics were prepared with a 5% wash added loading of the ZONYL 6991 (Inventive treatment, 25° C. wash, hand wrung, dried for 40 minutes in a dryer at 150° F. (65.5° C.)). The sample fabrics were stretched over a 1 in. (2.54 cm) internal diameter plastic tube and a piece of facial tissue was placed on top of the fabric (facing away from the tube). The fabric and tissue were secured to the tube in a watertight fashion by use of a plastic tie. The tube was oriented so that the fabric faced downward. Water was then gradually added to the tube until the tissue showed signs of wetting. The measured quantity of water added before wetting of the tissue was noted and was recorded as the corresponding porosity or breathability value. The results are set forth in Table 10.

TABLE 10

| Treatment Detail | Breathability (grams of water in column) |
|---|---|
| SCOTCHGARD treated side facing away from the water column | 0.44 |

TABLE 10-continued

| Treatment Detail | Breathability (grams of water in column) |
|---|---|
| SCOTCHGARD treated side facing toward the water column | 16.04 |
| Inventive Treatment | 0.12 |

The examples in Table 11 demonstrate the preferred transient durability of the inventive treatment, as measured by the slow loss of protection benefit imparted to the treated fabrics, illustrated by the slow loss of water repellency after multiple washes using a commercial detergent, but without subsequent treatment using the inventive compositions. Thus in actual use, fabrics treated using the inventive compositions will resist the build up of the fabric protective film that results from treatment which may otherwise compromise the appearance due to excessive coating and discoloration of the treated fabrics, or which may otherwise compromise the softness and handfeel of the treated fabrics after multiple treatments. Accordingly, fabrics treated using the inventive compositions will eventually lose their fabric protective benefits unless subsequent treatments with the inventive composition are repeated at some regular frequency. Advantageously, subsequent treatments may be employed using lower levels of the inventive composition to maintain the fill protective benefits provided to treated fabrics without the undesirable build-up of the treatment on said fabrics. The swatches were treated with a 5% loading of the invention for 12 min at 25° C. in the Terg-O-Tometer, then squeezed to remove excess solution and dried in the dryer for 40 min at 150° F. (65.5° C.). The commercially available pants were purchased from Spiegel precoated with TEFLON brand stain resistant coating. Both garments were washed in a residential washing machine with label recommended doses of LIQUID TIDE and subsequently dried in a residential dryer.

TABLE 11

| | Contact angle using water after 30 sec | |
|---|---|---|
| Number of wash cycles | Inventive Treatment | TEFLON treated pants |
| 1 | 96 | 117 |
| 2 | 22 | 112 |
| 3 | 0 | 110 |

Table 12 compares the handfeel of 100% cotton fabrics treated with the inventive treatment and those treated via a commercial application of fluoropolymer (SCOTCHGARD). Thirty respondents were asked to choose the garment with the best handfeel. The table shows the number of times each garment was chosen to have the better handfeel in a blind test. Respondents also indicated garments treated with the inventive treatment were visually less wrinkled than the commercially treated garments.

TABLE 12

| | Inventive Treatment | Commercially treated garment |
|---|---|---|
| Chosen better handfeel | 30 | 0 |

In the following examples, the surprising dependence of adding additional surfactants to the inventive treatment is demonstrated. These surfactants can be added either directly via the formulation, or via added detergent.

Table 13 shows the dependence of adding nonionic surfactants in addition to the inventive system. The swatches were treated with a 5% loading of the inventive treatment with various amount of surfactant added and exhausted for 12 min at 25° C. in the Terg-O-Tometer, then squeezed to remove excess solution. The swatches were then rinsed in water for 5 minutes at 25° C., squeezed to remove excess solution and dried in the dryer for 40 min at 150° F. (65.5° C.). The table reveals the contact angle for fabrics exhausted with a combination of the inventive treatment along with surfactant. It is clearly seen that at levels of nonionic surfactant equal to that supplied by use of a commercial detergent, the repellency is negligible, but surprisingly, there is a critical level at which a fabric protective benefit is still realized. This indicates that in some nonionic surfactant systems, such as those employed by commercial laundry detergents, addition of at least some zeta potential modifier may be further required in order to provide the optimum fabric protective benefit. Conversely, this also demonstrates that the level of use of primarily nonionic surfactant based detergents may be effectively reduced when used for cleaning clothing previously treated using the inventive treatment, as lower levels of the nonionic detergent would be sufficient to effectively clean treated clothing yet maintain, to some extent, the previously existing protective benefit carried by the clothing.

TABLE 13

| | 43 | 44 | 45 |
|---|---|---|---|
| ZONYL 6991 (g/l) | 0.98 | 0.98 | 1.23 |
| Non-ionic surfactant (g/l) | 0.11 | 0.22 | 0.43 |
| Contact angle water (initial) | 100 | 72 | 0 |

In another example, it was demonstrated that the inventive treatment can also tolerate low levels of anionic surfactants. In Table 14, the swatches were treated with a 5% loading of the inventive treatment with various amount of surfactant added and exhausted for 12 min at 25° C. in the Terg-O-Tometer, then squeezed to remove excess solution and dried in the dryer for 40 min at 150° F. (65.5° C.). The table reveals the resultant contact angles, demonstrating a surprising critical level in which the anionic surfactants can be incorporated. Furthermore, a commercially available laundry detergent was used at 10% and 100% of the recommended dosage. At full usage levels, no repellency is observed, however repellency was observed at the reduced level.

TABLE 14

| | 46 | 47 | 48 | 49 | 50 | 51 | 52 |
|---|---|---|---|---|---|---|---|
| ZONYL 6991 (g/l) | 1.23 | 1.23 | 1.23 | 1.23 | 1.23 | 1.23 | 1.23 |

TABLE 14-continued

| | 46 | 47 | 48 | 49 | 50 | 51 | 52 |
|---|---|---|---|---|---|---|---|
| Anionic surfactant(g/l) | 0.026[a] | 0.065[a] | 0.16[a] | 0.65[a] | | | |
| FRESH START | | | | | 0.043[b] | 0.22[b] | 0.43[b] |
| Contact angle water (initial) | 82 | 70 | 0 | 0 | 83 | 0 | 0 |

[a]Mixture of 77% AEOS and 23% LAS, both anionic surfactants.
[b]Commercial laundry detergent from Colgate-Palmolive, containing LAS and alcohol ethoxylate, 10% recommended level
[c]see footnote b, 50% recommended level
[d]see footnote b, 100% recommended level Surprisingly, the reduction of surfactant levels in the above examples, though key to the ultimate repellency imparted to the fabric, does not materially affect the final appearance of the washed samples relative to fabrics that were washed at full doses of detergent without the inventive system. Very good cleaning systems can thus be realized at significantly reduced surfactant levels, thereby reducing the overall biological challenge to the environment.

In the following three sets of experiments, fabric treatment compositions containing fluoropolymers, hydrophobic agents, and zeta potential modifiers were tested for their effectiveness in enhancing water and oil repellency. Although fragrance and colorant were not added in the compositions tested, these optional components typically would be included in commercial products at amounts of about 0.4% and 0.004%, respectively.

In the first experiments, six compositions each having the same amounts of fluoropolymers and hydrophobic agents but different amounts of zeta potential modifier (e.g., cationic surfactant in the form of a quaternary ammonium compound) were prepared. The compositions were diluted using water to effective use levels equivalent to 5% by weight of the undiluted compositions. The zeta potential of each composition was measured using two instruments, i.e., from Beckman and Particle Sizing. The compositions were also applied onto cotton fabrics with a U.S. Testing TERG-O-TOMETER water bath that was maintained at 70° F. (21° C.) to which cotton fabric and sufficient amounts of composition to produce a 5% load by fabric weight was attained. The fabric was exposed for 3.5 minutes and then dried in a commercial dryer at 150° F. (65.6° C.) for 50 minutes. The contact angles of water and oil droplets on the dried fabric were initially measured (initial contact angle, or t=0) and measured again 2 minutes later (t=2 min). The results are set forth in Table 15.

TABLE 15

| | Composition (wt. %) | | | Composition Parameters | | | | Contact Angle (t = 0-t = 2 min.) | |
|---|---|---|---|---|---|---|---|---|---|
| No. | ZONYL 8300(a) | MICHEM 743(b) | ACCOSOF T 550-75(c) | water* | pH | Zeta Pot. (mV)** | Zeta Pot. (mV)*** | Water | Oil |
| 53 | 34 | 51 | 0 | balance | 3.60 ± 0.05 | −21.2 | −9.1 | 0-0 | 0-0 |
| 54 | 34 | 51 | 2 | balance | 3.60 ± 0.05 | 36.5 | 21.2 | 116-112 | 116-116 |
| 55 | 34 | 51 | 4 | balance | 3.60 ± 0.05 | 45.1 | 27.9 | 111-103 | 115-115 |
| 56 | 34 | 51 | 6 | balance | 3.60 ± 0.05 | 51.7 | 33.6 | 114-107 | 118-118 |
| 57 | 34 | 51 | 8 | balance | 3.60 ± 0.05 | 55.5 | 36.2 | 95-89 | 116-116 |
| 58 | 34 | 51 | 10 | balance | 3.60 ± 0.05 | 57.9 | 36.6 | 70-63 | 105-105 |

(a)fluoropolymer 18% active
(b)paraffin 32% active
(c)cationic surfactant 75% active; Methyl bis(tallowamido ethyl)-2-hydroxyethyl ammonium methyl sulfate
*includes acid addition to adjust composition pH
**5% (by wt. of fabric) equivalent dilution measured by Beckman instrument
***5% (by wt. of fabric) equivalent dilution measured by Particle Sizing instrument.

As is apparent, the formulation containing no zeta potential modifier provided no repellency enhancement. Optimum repellency occurred where the level of this particular zeta potential modifier was between 2-6%; the water repellency decreased when the zeta potential level reached 8% or higher which suggests that too much of the zeta potential modifier may have an adverse effect as well. It is noted that the pH of the compositions were carefully adjusted to 3.60±0.05 for these experiments to minimize experimental variations in the measurement of zeta potential measurement. In practice, the compositions of the present invention may be adjusted to any desired pH as generally formulated for the intended usage and method of application desired for treating textiles and the like. The suitable operating pH range includes from about pH 1 to about pH 13, although the pH may optimally be adjusted to some value within this range to accommodate the stability and functionality of any optional adjuncts, such as surfactants or enzymes, for example, that perform best at some selected pH.

In the second set of experiments, eight identical fabric treatment compositions containing fluoropolymers, hydrophobic agents, and zeta potential modifiers were tested for their effectiveness in enhancing water and oil repellency. They were used with different types of detergents with and without a softener in a commercial washing machine. Specifically, cotton fabric was washed in a commercial washer (69 liter capacity, 6 lb (2.2 kg) ballast, 12 min. wash cycle at 93° F., or 34° C., and 3 min. rinse cycle at 68° F., or 20° C.) and 140.6 grams of one of the eight formations were added in the wash water. The fabric was dried in a drying machine for 50 minutes at 150° F. (66° C.). A primarily anionic surfactant containing detergent (LIQUID TIDE from Procter & Gamble Co.), a nonionic detergent (FRESH START from Colgate-Palmolive Co.), and/or a fabric softener that contained a cationic surfactant (DOWNY from Procter & Gamble) were also added as described herein. The contact angles of water and oil droplets were also measured after the fabric was dried. The procedures employed and the results are set forth in Table 16.

TABLE 16

| | Composition (wt %) | | | | Composition | Additional Commercial Products Added to Washing Machine | | Contact Angle-Cotton | |
|---|---|---|---|---|---|---|---|---|---|
| | ZONYL | MICHEM | ACCOSOFT | | parameters | | Added to | (t = 0-t = 2 min.) | |
| No. | 8300(a) | 743(b) | 550-75(c) | water* | pH | Added to Wash | Rinse | Water | Oil |
| 59 | 37.6 | 56.4 | 6 | balance | 3.60 ± 0.05 | none | Downy** | 113-93 | 113-110 |
| 60 | 37.6 | 56.4 | 6 | balance | 3.60 ± 0.05 | Downy** | none | 81-64 | 110-110 |
| 61 | 37.6 | 56.4 | 6 | balance | 3.60 ± 0.05 | Fresh Start | Downy** | 88-44 | 0-0 |
| 62 | 37.6 | 56.4 | 6 | balance | 3.60 ± 0.05 | Fresh Start and Downy** | none | 104-104 | 108-106 |
| 63 | 37.6 | 56.4 | 6 | balance | 3.60 ± 0.05 | Fresh Start | none | 0-0 | 0-0 |
| 64 | 37.6 | 56.4 | 6 | balance | 3.60 ± 0.05 | Liquid Tide | Downy** | 0-0 | 0-0 |
| 65 | 37.6 | 56.4 | 6 | balance | 3.60 ± 0.05 | Liquid Tide and Downy** | none | 36-0 | 15-0 |
| 66 | 37.6 | 56.4 | 6 | balance | 3.60 ± 0.05 | Liquid Tide | none | 0-0 | 0-0 |

(a)fluoropolymer 18% active
(b)paraffin 32% active
(c)cationic surfactant 75% active; methyl bis(tallowamido ethyl)-2-hydroxyethyl ammonium methyl sulfate
*includes acid addition to adjust composition pH
**Downy usage = 30 g/69 L As is apparent, detergent free systems (treatments 59 and 60) yield effective repellency when the fabric softener was added to either the wash or the rinse cycle. The presence of nonionic detergent yielded effective repellency when it is added to the washing cycle along with the softener as shown in treatment 62. Finally, the presence of predominately anionic detergent appears to disrupt the efficacy of treatment, with the softener added to either the wash (treatment 65) or rinse (treatment 64).

In a third set of experiments, three different treatment compositions were formulated and their effectiveness in enhancing water and oil repellency was tested in conjunction with either a liquid or dry anionic detergent (LIQUID TIDE or TIDE, respectively, from Procter & Gamble). Each composition had different amounts of zeta potential modifier. The fabrics tested in each case included a combination comprising 70% cotton material and 30% of a cotton/synthetic blend, which is designated p/c. The detergent, when employed, was added in the wash cycle. The treatment composition was added in the rinse cycle and, in one case, fabric softener, which included cationic surfactants, was also added in the rinse cycle.

It was expected that a small amount of detergent would adhere to the damp fabric following the wash cycle so that the residual detergent would re-dissolve into the water at the beginning of the rinse cycle. The results are presented in Table 17.

TABLE 17

| | Composition (wt. %) | | | | Composition | Commercial Products Added to Wash (Inventive Treatment | | Water Contact Angle | | Oil Contact Angle | |
|---|---|---|---|---|---|---|---|---|---|---|---|
| | ZONYL | MICHEM | ACCOSOFT | | parameters | weight) | | (t = 0-t = 2 min.) | | (t = 0-t = 2 min.) | |
| No. | 8300(a) | 743(b) | 550-75(c) | water* | PH | wash | Rinse | cotton | p/c | cotton | p/c |
| 67 | 34 | 51 | 6 | balance | 3.60 ± 0.05 | none | none (219 g) | 88-78 | 97-85 | 100-96 | 100-94 |
| | | | | | | Liquid Tide | none (219 g) | 69-45 | 0-0 | 0-0 | 0-0 |
| | | | | | | Liquid Tide | Downy (219 g) | 99-78 | 102-90 | 112-112 | 110-110 |
| 68 | 34 | 51 | 10.6 | balance | 3.60 ± 0.05 | none | none (219 g) | 109-89 | 114-106 | 113-110 | 115-110 |
| | | | | | | Liquid Tide | none (219 g) | 108-87 | 100-93 | 106-106 | 117-113 |
| | | | | | | Dry Tide | none (219 g) | 103-87 | 118-106 | 118-114 | 114-113 |
| | | | | | | Liquid Tide | none (219 g) | 118-98 | 112-98 | 111-104 | 112-108 |
| | | | | | | Liquid Tide | none (177 g) | 109-84 | 112-86 | 102-98 | 107-106 |
| | | | | | | Liquid Tide | none (118 g) | 0-0 | 0-0 | 0-0 | 0-0 |
| 69 | 34 | 51 | 13.1 | balance | 3.60 ± 0.05 | Liquid Tide | none (219 g) | 104-94 | 110-98 | 108-102 | 121-118 |
| | | | | | | Liquid Tide | none (177 g) | 100-85 | 113-103 | 110-108 | 111-108 |
| | | | | | | Liquid Tide | none (118 g) | 72-0 | 102-0 | 85-55 | 87-73 |

(a)fluoropolymer 18% active
(b)paraffin 32% active
(c)cationic surfactant 75% active; methyl bis(tallowamido ethyl)-2-hydroxyethyl ammonium methyl sulfate
*includes acid addition to adjust composition pH As is apparent, the 6% zeta potential modifier composition (No. 67) exhibited good repellency performance in the absence of wash added detergent but it exhibited poor repellency performance when detergent was added in the wash. However, the same formulation exhibited good repellency performance when a fabric softener was added to the rinse cycle to increase the amount of cationic surfactant, i.e., zeta potential modifier.

In addition, increasing the level of the zeta potential modifier (i.e., ACCOSOFT 550-75) to 10.6% in composition 68 improved repellency performance when detergent was present in the wash cycle but, even with the increase in zeta potential modifier, repellency performance actually decreased at the lower dose (i.e., 118 g) of treatment composition 68 when detergent was present in the wash. This suggests that the amount of zeta potential modifier was not enough to counteract the adverse effects of the anionic surfactants in the detergent. However, when the amount of zeta potential modifier was increased to 13.1%, there was an improvement in repellency performance even at the lower dose (i.e., 118 g) of treatment composition 69 when detergent was present.

In a fourth set of experiments, six different compositions containing a hydrophobic agent were prepared and their effectiveness in enhancing water and oil repellency was tested in conjunction with a zeta potential modifier. Each composition had different sources and amounts of both the hydrophobic agent and the zeta potential modifier. Test fabric swatches composed of either 100% cotton or mixed 50%/50% polyester/cotton (polycotton) blend were washed in a commercial washing machine along with 6 lbs of a mixed polycotton pillow case laundry load as ballast. The compositions of Table 18 were added at the beginning of the 12-minute wash cycle, to about 69 L of wash water containing 100 ppm hardness ions and 1.5 mM (millimolar) bicarbonate, containing the test fabrics and ballast. Wash conditions were a 12 minute wash cycle at a temperature of about 93° F., followed by a rinse cycle at a temperature of about 68° F., followed by spin drying. Test fabrics and ballast were then machine dried together for 50 minutes in a commercial automatic dryer set at a temperature of about 150° F. The test fabrics are removed from the dryer and water contact angles were measured to determine the water repellency properties of the treated fabrics.

As is apparent, the hydrophobic agent combined with a zeta potential modifier provides a fabric protective benefit to treated fabrics that show an increased contact angle with respect to water. The fabric protective benefit is particularly exampled in regards to the initial water contact angle, that is the contact angle determined immediately upon wetting of the fabrics by water (t=0), which indicates the degree of water repellency as well as repellency against any aqueous based material that would otherwise wet or stain the fabric not treated according to the method of the present invention. It is apparent that the fabric protective benefit is provided to natural fabrics, such as cotton, and synthetic fabrics, such as the polyester blend employed here for illustrative purposes.

As is apparent, any source of the zeta potential modifier combined with the hydrophobic agent is suitable for providing the fabric protective benefit according to the method of the present invention. Treatment with a hydrophobic agent alone as seen in the non-inventive example No. 74 does not result in a protective benefit on either natural or synthetic fabrics. It is also apparent that any source of a zeta potential modifier is suitable in combination with the hydrophobic agent. It is also apparent that any amount of zeta potential modifier, provided that there is at least sufficient zeta potential modifier present to provide for a zeta potential that is positive and greater than zero millivolts, is sufficient for the purpose of providing a fabric protective benefit in combination with the hydrophobic agent. It is also apparent that high levels of zeta potential modifier are not required according to the methods of the present invention to achieve the desired fabric protective benefits. At high levels of zeta potential modifier, generally levels that provide for a zeta potential that is greater than about +150 millivolts, no further increase in the fabric protective benefit is achieved. Without being bound by theory, it appears that the zeta potential modifier when present in compositions of the present invention at a level sufficient to provide a zeta potential of between greater than zero and about +150 mV, is sufficient to provide the fabric protective benefits to both natural and synthetic textiles according to the methods of the present invention.

Examples No. 76 through 99 in Table 19 represent inventive compositions providing both detergency and cleaning performance in addition to the protective benefits according to the methods of the present invention, and may suitably be employed in a wash liquor treatment.

It is to be noted that the foregoing examples demonstrate the manner in which the methods of the present invention provide for increased fabric protective benefits, including, but not limited to improved repellency against water and oil. It is further noted that the benefits with respect to improved repellency against water and oil also pertain to water-base, oil-based stains, respectively, and to particulate stains, and mixtures thereof. The foregoing examples further demonstrate the manner in which the methods of the present invention provide for improved handfeel to treated fabrics. The foregoing examples also demonstrate the manner in which the methods of the present invention provide improved fabric protective benefits without effectively reducing the breathability of treated fabrics with respect to water or moisture transmission.

Although only preferred embodiments of the invention are specifically disclosed and described above, it will be appreciated that many modifications and variations of the present invention are possible in light of the above teachings and within the purview of the appended claims without departing from the spirit and intended scope of the invention.

TABLE 18

| No. | Composition(a) Weight Added (grams) Michem 743(b) | Nalan GN(c) | Accosoft 550-75(d) | Commercial Product(a) Weight added (grams) Downy(e) | Water Contact Angle(g) (Time, seconds) Fabric Type(f) | t = 0 sec. | t = 30 sec. |
|---|---|---|---|---|---|---|---|
| 70 | | 140 | | | Cotton | 123 | 118 |
| | | | | | P/C | 126 | 115 |
| 71 | | 140 | 8.4 | | Cotton | 132 | 124 |
| | | | | | P/C | 127 | 127 |
| 72 | | 140 | | 30 | Cotton | 112 | 99 |
| | | | | | P/C | 115 | 85 |
| 73 | | 140 | 8.4 | 30 | Cotton | 111 | 86 |
| | | | | | P/C | 95 | 33 |
| 74 | 140 | | | | Cotton | 0 | - |
| | | | | | P/C | 0 | - |
| 75 | 140 | | 25.2 | | Cotton | 71 | - |
| | | | | | P/C | 81 | - |

(a)Added to washing machine wash water at start of wash cycle (b)Non-cationic microcrystalline wax emulsion from Michelman (c)Cationic paraffin wax emulsion from DuPont Chemicals containing a cationic methacrylate polymer (d)Cationic surfactant 75% active; Methyl bis(tallowamido ethyl)-2-hydroxyethyl ammonium methyl sulfate (e)Downy, a commercial fabric softener produced by Procter & Gamble (recommended for addition to rinse water).

(f)White 100% cotton and gray 50%/50% polyester/cotton (P/C) test swatches (g)Contact angle measured at indicated time following contact with water droplet to surface of treated test fabric

TABLE 19

| Component (weight %) | Composition No. 76 | 77 | 78 | 79 | 80 | 81 | 82 | 83 | 84 | 85 | 86 | 87 | 88 |
|---|---|---|---|---|---|---|---|---|---|---|---|---|---|
| Michem 743 | 75 | 75 | 75 | 75 | 75 | 75 | 75 | 75 | 75 | 75 | 75 | 75 | 75 |
| Nalan GN | | | | | | | | | | | | | |
| Zonyl 8300 | | 10 | | | | | | | | | | | |
| Zonyl NWG | | | 10 | | | | | | | | | | |
| Arquad 12-37W | 15 | 15 | 15 | 10 | 10 | 10 | 10 | 10 | 10 | 10 | 10 | 10 | |
| Accosoft 550-75 | | | | 2 | | | | | | | | | 15 |
| Bio-Soft D-40 (a) | | | | | 2 | | | | | | | | |
| Bio-Soft TA-2 (b) | | | | | | 2 | | | | | | | |
| Bio-Terge AS-40 (c) | | | | | | | 2 | | | | | | |
| Neodol 25-3S (d) | | | | | | | | 2 | | | | 2 | |
| Neodol 25-3 (e) | | | | | | | | | 2 | | | | |
| Neodol 25-9 (f) | | | | | | | | | | 2 | | 2 | |
| Neodol 23-6.5 (g) | | | | | | | | | | | 2 | | |
| Savinase 12.0 L (h) | | | | | | | | | | | | | |
| Balance water and minors (i) | q.s. | q.s. | q.s. | q.s. | q.s. | q.s. | q.s. | q.s. | q.s. | q.s. | q.s. | q.s. | q.s. |

| Component (weight %) | Composition No. 89 | 90 | 91 | 92 | 93 | 94 | 95 | 96 | 97 | 98 | 99 |
|---|---|---|---|---|---|---|---|---|---|---|---|
| Michem 743 | 75 | 75 | 75 | 75 | | | | | | | |
| Nalan GN | | | | | 75 | 75 | 75 | 75 | 75 | 75 | 75 |
| Zonyl 8300 | 10 | | | | | | | | | | |
| Zonyl NWG | | 5 | 5 | 5 | | | | 10 | | | 5 |
| Arquad 12-37W | | | | | | 15 | | | | | |
| Accosoft 550-75 | 10 | 15 | 10 | 10 | | | 10 | 10 | 10 | 10 | 10 |
| Bio-Soft D-40 (a) | | | 2 | | | | | | 2 | | 2 |
| Bio-Soft TA-2 (b) | | | | | | | | | | | |
| Bio-Terge AS-40 (c) | | | | | | | | | | | |
| Neodol 25-3S (d) | | | | 2 | | | | | | | |
| Neodol 25-3 (e) | | | | 2 | | | | | | | |
| Neodol 25-9 (f) | | | 2 | | | | | | | 2 | 2 |

TABLE 19-continued

| | | | | | | | | | | | |
|---|---|---|---|---|---|---|---|---|---|---|---|
| Neodol 23-6.5 (g) | | | | | | | | | | | |
| Savinase 12.0 L (h) | | | | | | | | | | | 0.5 |
| Balance water and minors (i) | q.s. | q.s. | q.s. | q.s. | q.s. | q.s. | q.s. | q.s. | q.s. | q.s. | q.s. |

(a) Bio-Soft D-40 Sodium alkylbenzene sulfonate, anionic surfactant available from Stepan Company
(b) Bio-Soft TA-2, Tallow amine ethoxylate, nonionic surfactant available from Stepan Company
(c) Bio-Terge AS-40; Sodium olefin sulfonate, anionic surfactant available from Stepan Company
(d) Neodol 25-3S; Alcohol ethoxylate sulfate; anionic surfactant available from Shell Chemicals
(e) Neodol 25-3; Alcohol ethoxylate, nonionic surfactant available from Shell Chemicals
(f) Neodol 25-9; Alcohol ethoxylate, nonionic surfactant available from Shell Chemicals
(g) Neodol 23-6.5; Alcohol ethoxylate, nonionic surfactant available from Shell Chemicals
(h) Savinase, a protease enzyme available from Novozymes Company
(i) q.s. Quantity sufficient to achieve 100 weight % of final composition

What is claimed is:

1. A method of treating fabrics in a washing machine to provide first fabric protective properties and subsequent second fabric protective properties to a fabric, comprising the steps of:

(1) depositing a first composition onto the fabric in a first treatment liquor, wherein the first composition comprises:

a) a hydrophobic agent that does not cause any significant color change, nor impart any discoloration to a fabric, characterized as having a melting point or glass transition temperature of less than 100° C.;

b) a fluoropolymer; and c) an effective amount of a zeta potential modifier;

such that the first treatment liquor has a zeta potential that is positive and greater than zero millivolts;

(2) first curing said fabric at a temperature above ambient temperature but less than 100° C.;

(3) depositing a second composition onto the fabric in a second treatment liquor, wherein the second composition comprises:

d) a hydrophobic agent that does not cause any significant color change, nor impart any discoloration to a fabric, characterized as having a melting point or glass transition temperature of less than 100° C.; and e) an effective amount of a zeta potential modifier;

f) and does not comprise a fluoropolymer;

such that the second treatment liquor has a zeta potential that is positive and greater than zero millivolts; and (4) subsequently curing said fabric at a temperature above ambient temperature but less than 100° C.;

wherein:

i) said first fabric protective properties comprise: increased water repellency; increased oil repellency; soil and stain release; improved handfeel; improved softness; improved resistance to damage; and any combination thereof;

ii) said second fabric protective properties comprise at least one of said first fabric protective properties;

iii) said hydrophobic agent is not a fluoropolymer;

iv) said zeta potential modifier comprises a cationic or cationically modified material; and v) the ratio of hydrophobic agent to zeta potential modifier is at least 1:3.

2. The method of claim 1, further comprising the step of:

5) said repeating step (3) and step (4) a plurality of times with the fabric to maintain said second fabric protective properties, wherein said second composition comprises a level of hydrophobic agent less than the level of hydrophobic agent present in said first composition.

3. The method of claim 1 wherein said first composition comprises:

a. 0.5 to 60 weight % hydrophobic agent;

b. 5 to 30 weight % fluoropolymer; and c. an effective amount of a zeta potential modifier so that the first treatment liquor has a zeta potential that is positive and greater than zero millivolts; and wherein said second composition comprises:

d. a level of hydrophobic agent less than the level of hydrophobic agent present in said first composition; and e. an effective amount of a zeta potential modifier so that the second treatment liquor has a zeta potential that is positive and greater than zero millivolts.

4. The method of claim 1, wherein said zeta potential modifier independently comprises 0.1 to 30 weight % in each of the first composition and the second composition.

5. The method of claim 1, wherein the cationic material is a cationic surfactant selected from the group consisting of mono and di-methyl fatty amines, alkyl trimethyl ammonium salts, dialkyl dimethyl ammonium salts, alkyl amine acetates, trialkylammonium acetates, alkyldimethylbenzyl ammonium salts, dialkylmethylbenzyl ammonium salts, alkylpyridinium halide and alkyl (alkyl substituted) pyridinium salts, alkylthiomethylpyridinium salts, alkylamidomethylpyridinium salts, alkylquinolinium salts, alkylisoquinolinium salts, N,N-alkylmethylpyrollidinium salts, 1,1-dialkylpiperidinium salts, 4,4-dialkylthiomorpholinium salts, 4,4-dialkylthiomorpholinium- 1-oxide salts, methyl bis (alkyl ethyl)-2-alkyl imidazolinium methyl sulfate (and other salts), methyl bis(alkylamido ethyl)-2-hydroxyethyl ammonium methyl sulfate (and other salts), alkylamidopropyl-dimethylbenzyl ammonium salts, carboxyalkyl-alkyldimethyl ammonium salts, alkylamine oxides, alkyldimethyl amine oxides, poly (vinylmethylpyridinium) salts, poly(vinylpyridine) salts, polyethyleneimines, trialkyl phosphonium bicarbonates (and other salts), trialkylmethyl phosphonium salts, alkylethylmethylsulfonium salts, and alkyldimethylsulfoxonium salts.

6. The method of claim 1, wherein the cationically modified material is selected from the group consisting of: cationically modified organic polymers, cationically modified biopolymers, cationically modified clays, cationically modified silicas, cationically modified nanoparticles, and mixtures thereof.

7. The method of claim 1, wherein said hydrophobic agent is at least partly insoluble in water at a temperature of about 20° C.

8. The method of claim 1, wherein said hydrophobic agent is selected from the group consisting of hydrophobic waxes, polymers produced from ethylenically unsaturated monomers, low molecular weight polyethylene, low density polyethylene, polypropylene, oxidized polyethylene, oxidized polypropylene, polyolefin, polyurethane, ethyl vinyl acetate, polyvinyl chloride, co-polymers, and emulsifiable waxes.

9. The method of claim 1, wherein the composition comprises an aqueous liquid carrier that optionally includes a low molecular weight organic solvent.

10. The method of claim 9, wherein said aqueous liquid carrier comprises 20% to 80% by weight of the composition.

11. The method of claim 1, wherein said first composition further comprises an additive selected from the group consisting of emulsifiers, pH adjusters, silicones, non-ionic surfactants, cationic surfactants, amphoteric surfactants, zwitterionic surfactants, anionic surfactants, soil release agents, soil release polymers, antistatic agents, fragrances, fragrance extenders, antimicrobial actives, preservatives, dyes, colorants, viscosity control agents, antifoaming agents, pearlizing agents, opacifying agents, antioxidants, sunscreens, dye transfer inhibitors, dye fixative agents, dispersants, chlorine scavengers, wetting agents, electrolytes, enzymes, bleaching agents, brighteners, heavy metal chelating agents, fabric softener actives, soil suspending agents, soil release agents, and mixtures thereof.

12. The method of claim 1, wherein the hydrophobic agent of the first composition has a melting point or glass transition temperature between 45° C. and 100° C.

13. A method of treating a fabric article in a washing machine to provide a first fabric protective property and a subsequent second fabric protective property to said fabric article, comprising the steps of:

(1) contacting a first composition with said fabric article in a first treatment liquor, wherein said first composition comprises:

a. 0.5 to 60 weight % of a hydrophobic agent that does not cause any significant color change, nor impart any discoloration to a fabric;

b. 5 to 30 weight % of a fluoropolymer; and c. an effective amount of a zeta potential modifier;

such that said first treatment liquor has a zeta potential that is positive and greater than zero millivolts;

(2) first curing said fabric article at a temperature above ambient temperature but less than 100° C.;

(3) contacting a second composition with said fabric article in a second treatment liquor, wherein said second composition comprises:

d. a hydrophobic agent, that does not cause any significant color change, nor impart any discoloration to a fabric, at a weight % level less than that present in said first composition;

e. an effective amount of a zeta potential modifier so that said second treatment liquor has a zeta potential that is positive and greater than zero millivolts; and f. and does not comprise a fluoropolymer;

(4) subsequently curing said fabric article at a temperature above ambient temperature but less than 100° C.;

wherein:

i) said first fabric protective property comprises a property selected from the group consisting of: increased water repellency, soil and stain release, increased oil repellancy, improved handfeel, improved softness, improved resistance to damage, and combinations thereof;

ii) said second fabric protective property comprises at least one of said first fabric protective property;

iii) said hydrophobic agent is not a fluoropolymer; and iv) the ratio of hydrophobic agent to zeta potential modifier is at least 1:3.

14. The method of claim 13, wherein said first composition comprises:

a. 5 to 10 weight % hydrophobic agent;

b. 5 to 30 weight % fluoropolymer; and c. 0.1 to 5 weight % zeta potential modifier; and wherein said second composition comprises:

d. 0.1 to 2.5 weight % hydrophobic agent; and e. 0.1 to 5 weight % zeta potential modifier.

15. The method of claim 13, wherein said first and second compositions independently further comprises at least one of an additive selected from the group consisting of: emulsifiers, pH adjusters, silicones, non-ionic surfactants, cationic surfactants, amphoteric surfactants, zwitterionic surfactants, anionic surfactants, soil release agents, soil release polymers, antistatic agents, fragrances, fragrance extenders, antimicrobial actives, preservatives, dyes, colorants, viscosity control agents, antifoaming agents, pearlizing agents, opacifying agents, antioxidants, sunscreens, dye transfer inhibitors, dye fixative agents, dispersants, chlorine scavengers, wetting agents, electrolytes, enzymes, bleaching agents, brighteners, heavy metal chelating agents, fabric softener actives, soil suspending agents, soil release agents, and mixtures thereof.

16. The method of claim 14, wherein at least one of said first composition and said second composition is an aqueous composition.

17. The method of claim 16, wherein the aqueous composition includes from 0.01 to 10 weight % bleaching agent.

18. The method of claim 16, wherein the aqueous composition includes a brightener.

19. The method of claim 16, wherein the aqueous composition includes a surfactant.

20. The method of claim 13, wherein the curing in at least one of step (2) and step (4) occurs above ambient temperature but less than 70° C.

* * * * *